US005878618A

United States Patent [19]

Stalzer

[11] Patent Number: 5,878,618

[45] Date of Patent: Mar. 9, 1999

[54] MACHINE FOR BENDING SHEET AND PLATE METAL THROUGH DUAL WEDGE SYSTEM

[76] Inventor: Leo Henry Stalzer, 150 Sunken Forest Dr., 8-218, Forsyth, Mo. 65653

[21] Appl. No.: 801,439

[22] Filed: Feb. 18, 1997

Related U.S. Application Data

[63] Continuation-in-part of Ser. No. 446,246, May 22, 1995, abandoned.

[51] Int. Cl.[6] ..... B21D 5/02; B21J 9/18

[52] U.S. Cl. ..... 72/452.9; 100/271

[58] Field of Search ..... 72/452.8, 452.9, 72/172, 174; 100/214, 271

[56] References Cited

U.S. PATENT DOCUMENTS

| | | |
|---|---|---|
| 7,465 | 6/1850 | Underwood . |
| 509,265 | 11/1893 | Tweddell et al. . |
| 552,710 | 1/1896 | Jefferies . |
| 986,481 | 10/1911 | Scheld . |
| 2,400,996 | 12/1946 | Iversen . |
| 2,797,583 | 7/1957 | Laschenski . |
| 2,798,583 | 7/1957 | Jeszka et al. . |
| 3,678,792 | 7/1972 | Dvorak . |
| 3,913,438 | 10/1975 | Walters et al. . |
| 3,933,070 | 1/1976 | Walters et al. . |
| 3,939,686 | 2/1976 | Walters et al. . |
| 4,166,369 | 9/1979 | Nakajima . |
| 4,352,284 | 10/1982 | Woods . |
| 4,357,820 | 11/1982 | Blanchard . |
| 4,459,889 | 7/1984 | Holton et al. . |
| 5,186,037 | 2/1993 | Bibler . |

OTHER PUBLICATIONS

Press–Brake and Shear Handbook, copyright 1965 by Cahners Books, (Second Printing, Mar. 1972), pp. 36–43.

"Difficult is Easy", Pride in Metal–Forming Machinery by Lion Servies, Inc.

"Lion Manual Cheekbender" by Lion Services, Inc.

"Press Brakes", The Simple Solution, manufactured by Betenbender.

"Hydraulic Bender", from FECO Engineered Systems, Inc.

*Primary Examiner*—David Jones

*Attorney, Agent, or Firm*—Polster, Lieder, Woodruff & Lucchesi

[57] ABSTRACT

A press brake, or other machine for bending sheet metal or plate metal, comprises a frame, a bed mounted to the frame, and a ram movably mounted to the frame. An assembly for moving the ram relative to the bed to bend sheets and plates of metal positioned between the ram and bed comprises first and second wedges, and first and second inclined ramp surfaces that the wedges slide relative to when moving in first and second directions relative to the frame to move the ram toward and away from the bed for bending operations. The assembly has an actuator which moves the first and second wedges relative to the ramp surfaces. The first and second wedges are drivingly linked to balance distribution of force across the ram. A Vernier scale assembly is mounted generally horizontally with the ram and wedges, to allow setting a scale component to control switching means to stop downward ram movement at a desired point. The press brake can be provided with a pivoting mechanism which enables the ram to be pivoted about an axis relative to the bed to position the ram at a selected angle relative to the bed.

30 Claims, 13 Drawing Sheets

MACHINE FOR BENDING SHEET AND PLATE METAL THROUGH DUAL WEDGE SYSTEM

CROSS-REFERENCE TO RELATED APPLICATIONS

This application is a continuation-in-part application of application Ser. No. 446,246 filed May 22, 1995, now abandoned, which in turn relates to a Disclosure Document filed by the applicant having Disclosure Document No. 369750 filed on Feb. 13, 1995, both of which are incorporated by reference as part of this application.

FIELD OF THE INVENTION

The present invention relates to machines for bending sheet and plate metal through use of a wedge activated system to move the ram and the bed of a press together to bend the metal sheets or plates.

BACKGROUND AND SUMMARY OF THE INVENTION

In the prior art, heavy machines for bending plates and sheets of metal have used a wedge drive system to apply pressing or cutting force. However none of the prior art machines have employed structure that provides the advantages of the present invention.

The present invention features a press brake, or other similar heavy machine for bending sheet metal or plate metal. The invention comprises a frame, a bed mounted to the frame, and a ram movably mounted to the frame. The ram has a lower tooth punch with a horizontal lower edge which interfaces with a female die which has a horizontally extending V-shaped slot. An assembly for moving the ram to and from the bed to bend the metal therebetween has first and second wedges which move between inclined ramp surfaces and slide surfaces. The movement of the wedge along the inclined surface causes the ramp to move toward and away from the bed. The dual wedges are driven by an actuator, positioned between the two wedges. The actuator can be a single unit, or double unit. The actuator is drivingly connected to the wedges to move them in first and second directions. The movement of the wedges applies force to the ram to cause it to move to and from the bed. Because the actuator is positioned between the two wedges, the force the wedges apply to the ram is applied to the two ends of the ram to thereby apply an even distribution of force across the ram. The two wedges are linked to each other by means such as link plates, so that the movement of one wedge transfers force to the second wedge to move it the same distance as the first wedge. The linkage of the two wedges provides for the horizontal edge of the ram tooth punch to be maintained parallel with the horizontal V-shaped slot of the female die, and provide for even distribution of force to the ends of the ram and across the ram. This balancing of force across the ram allows even and straight bending of the metal sheets and plates positioned between the ram and bed.

In one embodiment the actuator comprises a pair of power sources such as hydraulic or pneumatic cylinders, which have different power outputs. Each of the power sources can have a drive member extending from its exterior end to be drivingly associated with a respective wedge. This dual wedge action further allows for a balancing force across the ram. With a dual power operation, a variation of power can be more easily applied to the ram. For example one of the cylinders can be used at a certain stage of the operation such to rapidly move the ram to close engagement with the metal sheet or plate prior to bending, and then both cylinders can be used when more force more force is desired to be applied to bend the plate or sheet.

In one embodiment a single cylinder assembly can be used with the cylinder connected to the ram or frame, with a driving member extending from the cylinder to move one of the wedges. The link plates connecting the wedges cause both wedges to be moved by the single actuator. In another embodiment an actuator such as a single hydraulic or pneumatic cylinder can have a drive rod extending from each of its opposite ends to be connected to each of the wedges to move the wedges to cause the ram to move toward and away from the bed for bending operation.

With the actuator, whether it be the dual cylinder arrangement or the single cylinder arrangement, positioned between the two wedges, an even distribution of force across the ram takes place, and a compact structure is also provided. The system thus allows for application of the mechanical advantage offered by the wedges in movement of the ram relative to the bed. The placement of the actuator between the wedges further allows for lack of congestion about the ends of the machine.

Guide plates mounted to the sides of the wedges keep the wedges on track during sliding movement. The side plates have guide members extending therefrom which contact the ram and the slide members to provide for steady and smooth movement, with lubricant mounted within the engagement members.

The present invention further provides for a scaled means for adjusting the movement of the ram, which comprises a component mounted to the assembly that moves with the ram, such as on the link plate in the preferred embodiment. It has another component associated with the wedge assembly, such as being mounted on the link plate in the preferred embodiment, which component in the preferred embodiment is a cam. The means for adjusting movement further comprises a switch that is associated with the ram which has means to interact with the cam, such as through a cam arm. The cam can trip the switch to control the downward movement or depth of penetration of the ram into the bed. The means for adjusting includes a scale assembly which has a scale associated with the wedge assembly such as on the cam. The cam scale can be adjusted relative to the depth of penetration of the ram toward the bed. Another scale component extends generally horizontally relative to the wedge assembly, such as horizontally on the link plate. The cam scale can be adjusted and set relative to the other scale component to thereby set the depth of downward movement of the ram toward the bed. The two scale components can form a Vernier Scale arrangement to allow for greater accuracy in setting the position of the downward penetration. A second cam can interact with a switch to stop the ram just before contact with the sheet or plate. A third cam can activate a switch to limit upward travel of the ram.

In another embodiment, the press brake is provided with a pivoting mechanism for pivoting the ram about a pivot axis relative to said bed. A bolt passes through the second wedge to connect the second wedge to its associated guide plates, and link plates, if provided. The pivot mechanism comprises a mounting assembly for adjustably mounting said first ramp member to said frame, such that the horizontal position of said first ramp member can be selectively set prior to movement of said ram. The pivot mechanism further comprises a linear motion device operably connected between the first frame and an outer surface of the first ramp member to move the first ramp member in a first direction towards the second ramp member and in a second direction away from the second ramp member. Thus, movement of the first ramp member relative to the second ramp member causes the first ramp member to move relative to the first wedge and causes the ram to pivot about the pivot axis. The mounting assembly preferably includes a horizontal member and the first ramp member has a substantially horizontal surface opposite its angled surface. The first ramp member is slidably mounted to the horizontal member of the mounting assembly by means of an interfitting groove and tennon arrangement. The linear motion devices is preferably a bolt which passes through a leg that extends parallel to the outer surface of the first ramp member. The bolt is connected to the outer surface of the first ramp member so that it may both push and pull the first ramp member as it is rotated.

The press brake or other like bending machine of the present invention thus provides advantages over the prior art not heretofore achieved.

DESCRIPTION OF PREFERRED EMBODIMENTS

General Description

Figure 1:
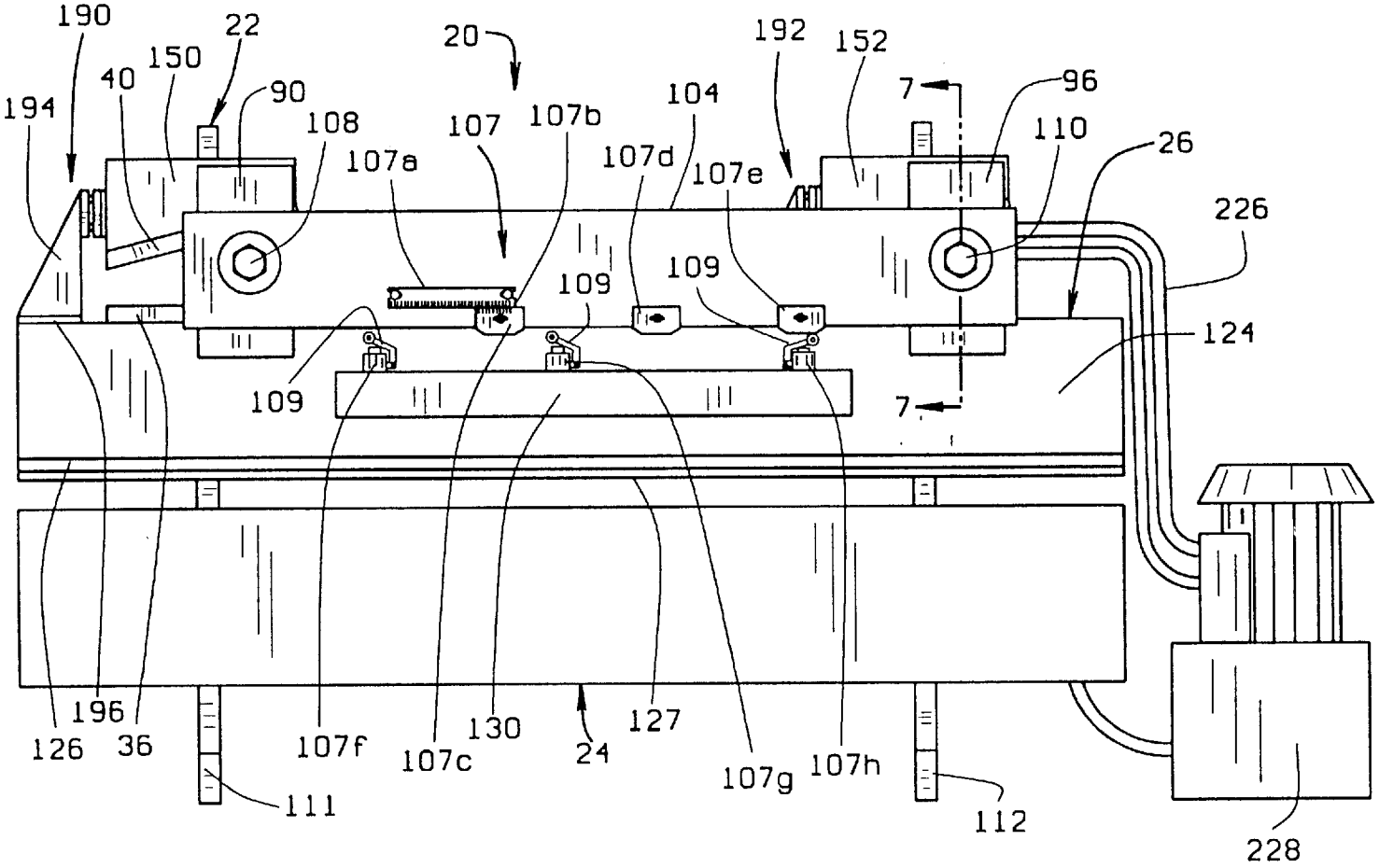
FIG. 1 is a front elevational view showing an embodiment of a bending machine for bending sheet and plate metal in the form of a press brake, with the ram shown in the up position.
Figure 2:
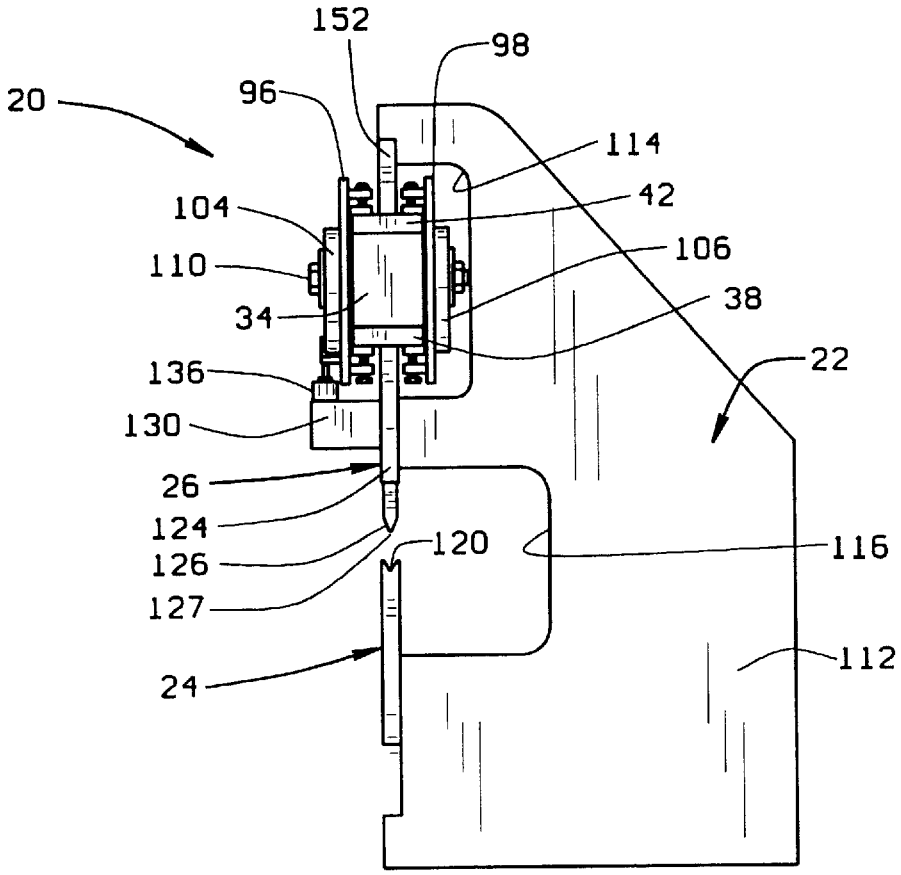
FIG. 2 is a right end view of the machine of FIG. 1.
Figure 9:
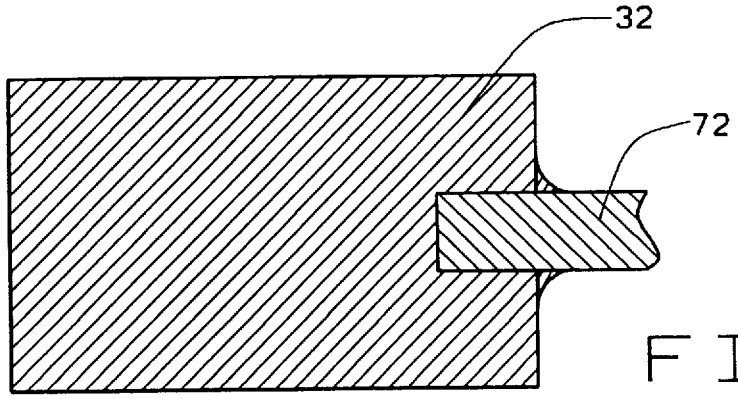
FIG. 9 is a section view taken on the line 9—9 of FIG. 3.

First a general description of a first embodiment of the invention will be given. Referring first to the embodiment shown in FIGS. 1–12, a press brake machine 20 for bending sheet and plate metal has a stationary frame 22, a bed 24 mounted to frame 22, and a ram 26 mounted to frame 22 to move toward and away from the bed 24. An assembly 28 (FIG. 3) for moving the ram 26 relative to the bed 24 to bend sheets and plates of metal comprises first and second sliding wedges 32 and 34, first and second slide plates 36 and 38 secured to the top of ram 26, and first and second ramp plates 40 and 42 secured to the frame 22 above the slide plates 36 and 38. Wedge 32 slides between the slide plate 36 and the inclined ramp 40, while wedge 34 slides between slide plate 38 and ramp 42. Means 48 for actuating wedge movement comprises first and second hydraulic cylinders 50 and 52 which are shown to be of different sizes. Cylinders 50 and 52 have inwardly extending members 54 and 56 mounted by nuts and bolts 58 and 60 (FIG. 6) to a connecting plate 62. Plate 62 is secured as by a weld to the upper middle end of ram 26. The cylinders 50 and 52 power slidable drive members 68 and 70 that extend from the outer ends of cylinders 50 and 52. Drive members 68 and 70 are connected to drive rods 72 and 74 with nuts and bolts 75. Drive rods 72 and 74 are in turn drivingly connected to wedges 32 and 34. The rods 72 and 74 can thus slide the wedges 32 and 34 in a first direction to the left of FIGS. 1 and 3–5 to move the ram 26 toward the bed 24 to bend a metal sheet or plate located therebetween, and in a second direction toward the right of FIGS. 1 and 3–5, to move ram 26 away from bed 24 to allow removal or repositioning of the bent sheet or plate. Thus, when the wedges 32 and 34 are moved to the left by the cylinders 50 and 52, the ram 26 is moved toward the bed 24 by the interengagement or cooperation of the wedges 32 and 34 with the ramps 40 and 42.

A pair of front and rear guide plates 90 and 92 (FIG. 6) are mounted to the front side and backside of wedge 32, respectively, while front and rear guide plates 96 and 98 are likewise mounted to the front side and backside of wedge 34, respectively. The guide plates 90, 92, 96 and 98 confine travel of the wedges 32 and 34 between their respective slide plates 36 and 38 and ramps 40 and 42. Front and rear connecting link plates 104 and 106 are secured to guide plates 96 and 98 by nuts and bolts 108 and 110 passing therethrough and through wedges 32 and 34. The link plates 104 and 106 allow the force that moves wedge 32 by cylinder 50 to be transferred to wedge 34, and likewise allows the transfer of force from cylinder 52 to wedge 34 to be transferred to wedge 32. Link plates 104 and 106 thus allow an equal application of force to each of the wedges 32 and 34, and thus an equal application of force by the wedges 32 and 34 to the ends of the ram 26. This provides for maintaining the lower edge of the ram 26 parallel with the upper edge of the bed 24, and for an even application of force by ram 26 against the sheet or plate of metal that is bent.

A scale adjustment assembly 107 (FIGS. 10 and 11) comprises a generally horizontally extending scale plate 107*a* mounted on link plate 104, which interacts with a corresponding generally horizontally extending scale 107*b* on cam plate 107*c*. Cam plate 107*c* can be adjustably set relative to link plate 104. Cam plates 107*d* and 107*e* (FIG. 1) are also adjustably mounted to link plate 104. Mounted to the front of ram 26 are three switches 107*f*, 107*g*, and 107*h*, each of which have cam arms 109 with rollers that interact with the surfaces of cam plates 107*c*, 107*d* and 107*e*, respectively. Cam plate 107*c* and switch 107*f* control the downward movement of ram 26 relative to bed 28. Both such components on scale plate 107*a* and 107*b* on cam 107*c* have vertical markers that can be aligned with each other as desired, so that adjustable cam 107*c* can be moved to be set at the desired spot to stop ram 26 at the desired point of downward movement.

More Detailed Description of FIGS. 1–12 Embodiment

Now a more detailed description of the embodiment shown in FIGS. 1–12 will be given. The frame 22 comprises a pair of vertical uprights 111 and 112 each of which has an upper and lower C-shaped opening shown as 114 and 116 for upright 112 in FIG. 2. Bed 24 comprises a vertical metal plate having its inside adjustably mounted to the front edge of each of uprights 111 and 112 beneath the C-shaped opening 116. Bed 24 acts as a lower jaw in the pressing process, and has a female die with a V-shaped slot 120 in its upper end. The ram 26 comprises a metal upper vertical jaw plate 124 to which a lower tooth punch 126 is attached. Tooth punch 126 has a horizontal lower edge 127. The upper edge of ram plate 124 is welded to the undersides of wedge slide plates 36 and 38 to thereby mount ram 26 to moving assembly 28. When the hydraulic cylinders 50 and 52 are activated to move the drive members 68 and 70 and drive rods 72 and 74 to slide the wedges 32 and 34 to and fro as heretofore described, the ram plate 126 and tooth punch 126 are moved up and down by virtue of ram plate 126 connection to the slide plates 36 and 38. The front side of ram plate 126 has a metal switch mounting plate 130 secured to it as by welding. The switches 107*f*, 107*g* and 107*h* are mounted to the top of switch plate 130.

Frame 22 comprises fixed position wedge plates 150 and 152 to which the upper part of assembly 28 is mounted. The upper ends of fixed wedge plates 150 and 152 fit in rectangular notches in frame uprights 111 and 112 (FIG. 2) located above the top of C-shaped openings 114, and secured by welding. Fixed wedges 150 and 152 have their lower slanted edges secured by welding to the top surfaces of slanted ramps 40 and 42, respectively.

Figure 3:
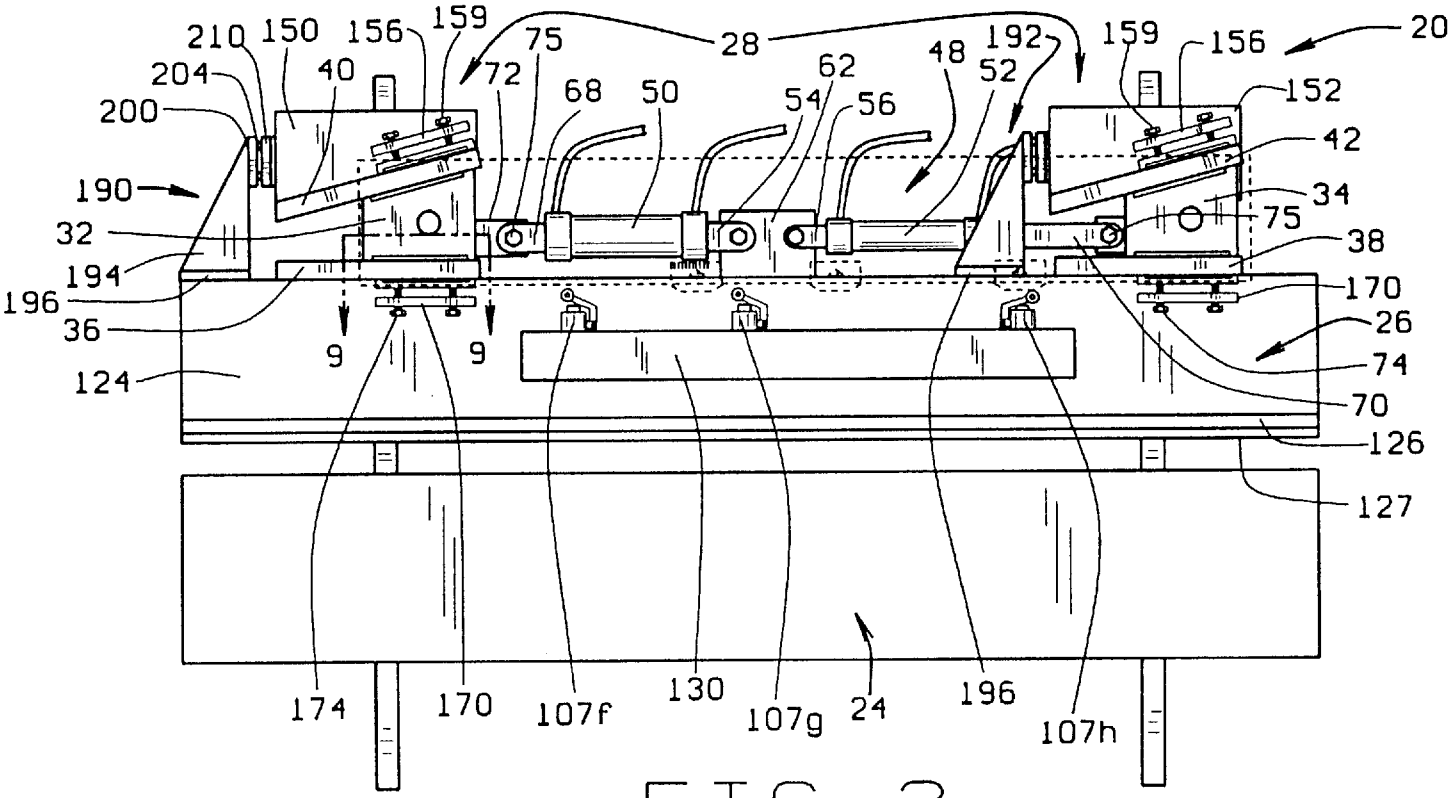
FIG. 3 is a front elevation of the machine of FIG. 1, with the front link plate and switch control tabs shown in dashed lines, and not showing the front guide plates and rear link plate.
Figure 4:
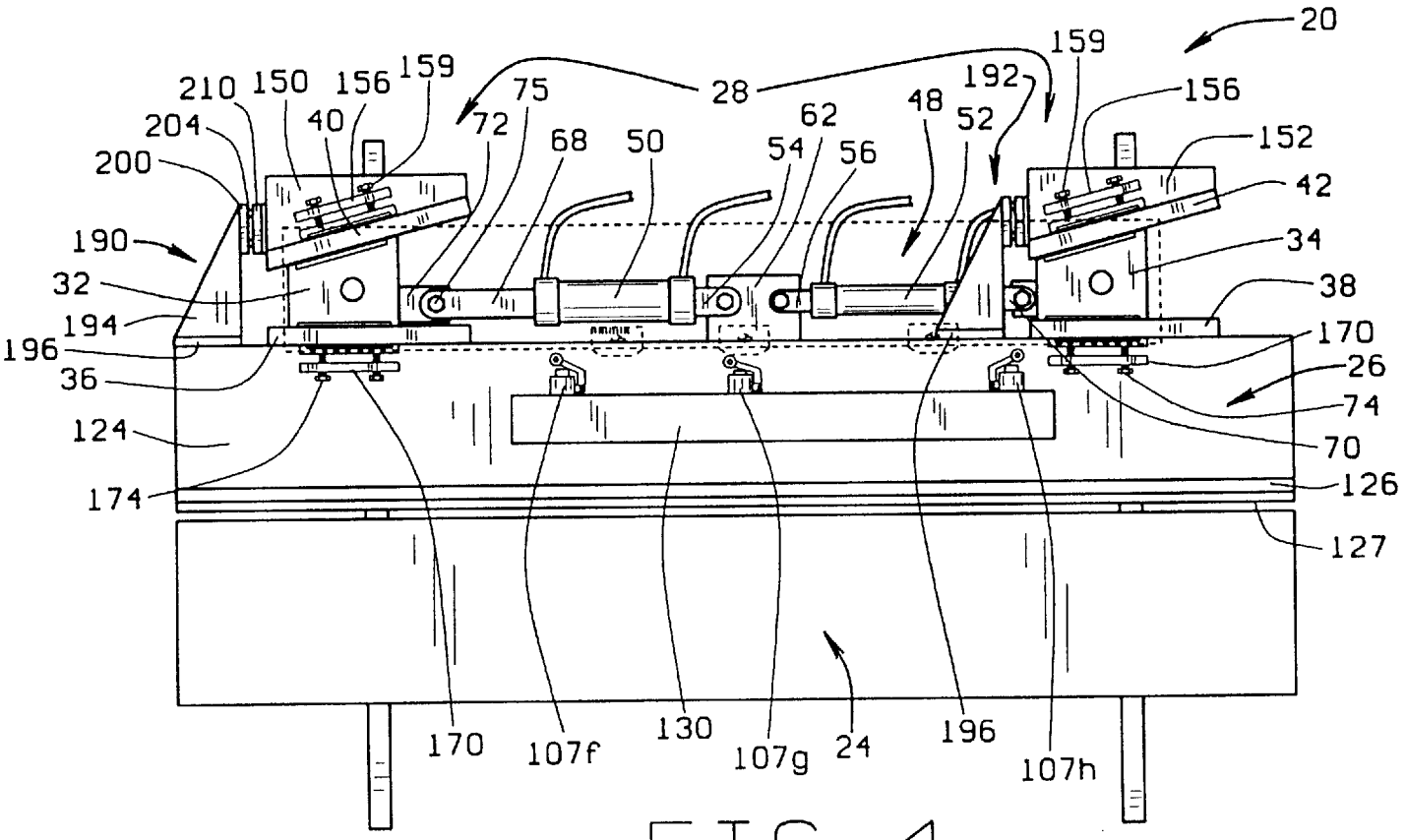
FIG. 4 is a front elevation of the machine, with the same parts shown in dashed lines and not shown as in FIG. 3, and with the ram shown in a lower position than that of FIGS. 1 and 3.
Figure 5:
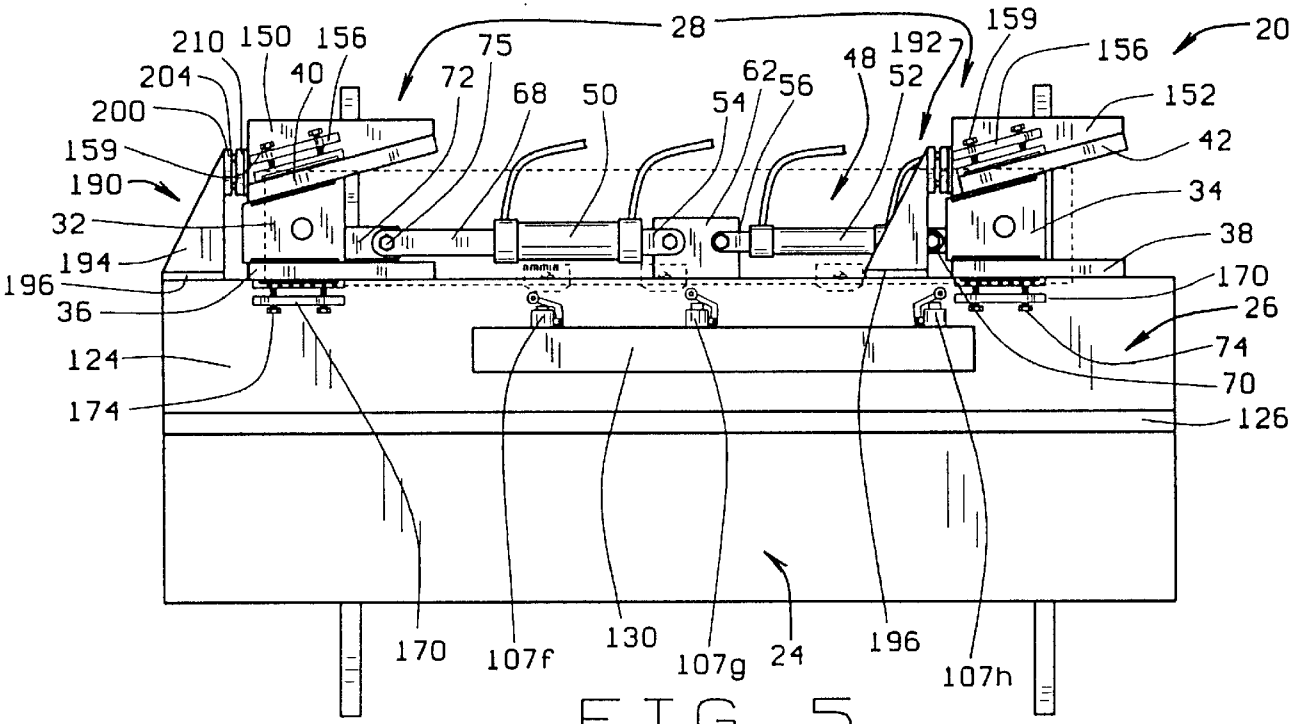
FIG. 5 is a front elevation of the machine, with the same parts shown in dashed lines and not shown as in FIG. 3, and with the ram shown in its bottom position for bending metal sheets and plates.
Figure 6:
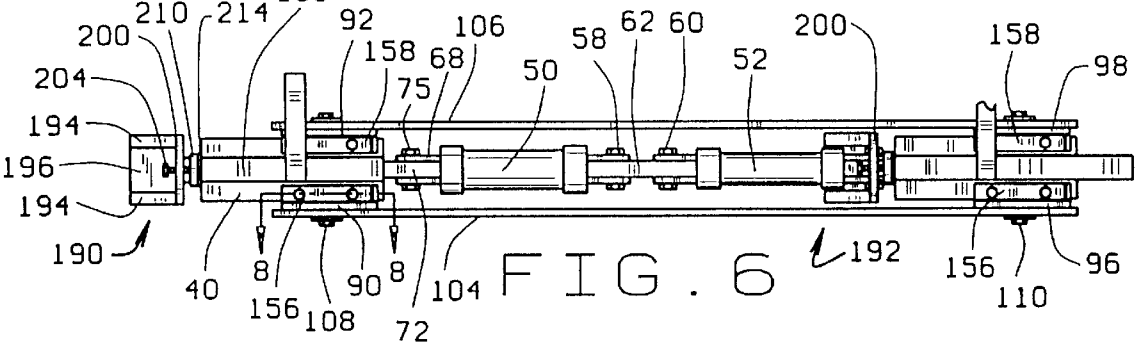
FIGS. 6 is a top plan view of the machine in its position of FIGS. 1 and 3.
Figure 8:
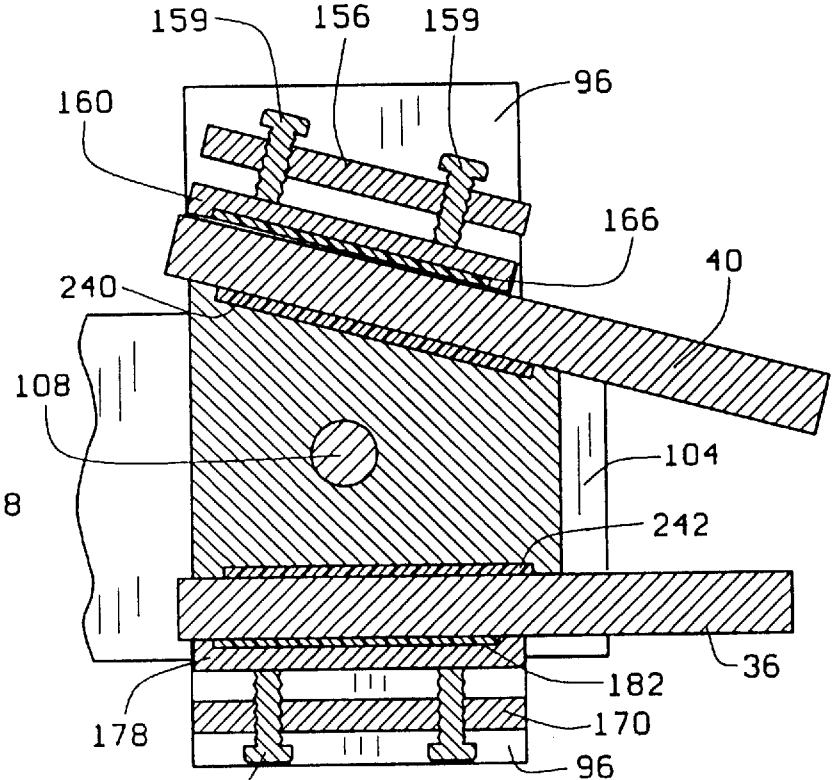
FIG. 8 is a section view taken on the line 8—8 of FIG. 6.
Figure 7:
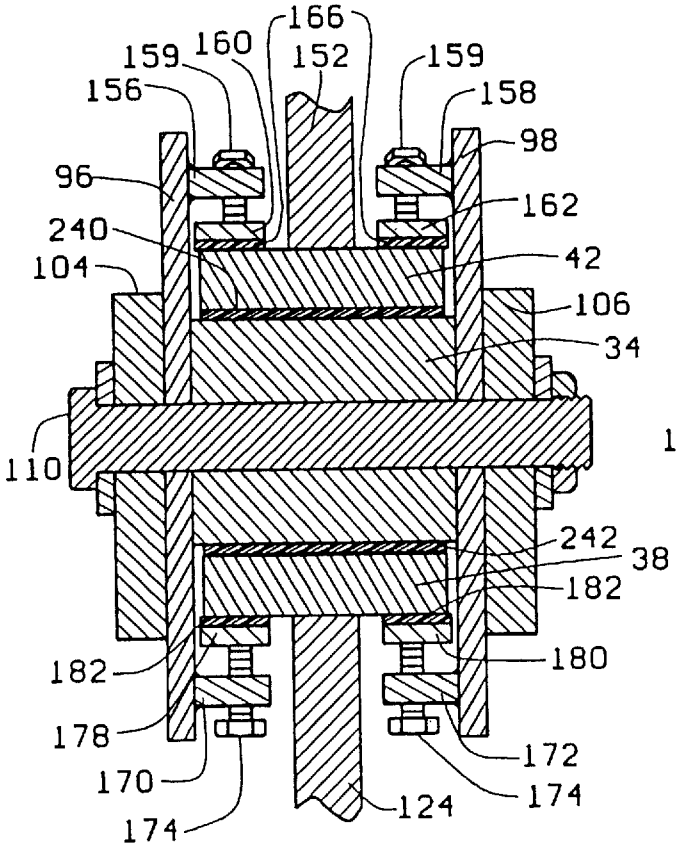
FIG. 7 is a section view taken on the line 7—7 of FIG. 1.

The front guide plates 90 and 96, as seen more clearly in FIGS. 7 and 8, have upper inwardly extending flanges 156 welded to the inside thereof. Rear guide plates 92 and 98 likewise have flanges 158 welded to the inside thereof. A pair of bolts 159 are threaded downwardly through each of the flanges 156 and 158, with the lower bolt ends secured to adjustable plates 160 and 162. The plates 160 and 162 have a flat sandwich sheet 166 of plastic and metal with a low coefficient of friction contained within the downwardly facing opening thereof to abut the top surface of ramps 40 and 42. Welded to the lower inside of each front guide plate 90 and 96, are flanges 170. In FIGS. 3, 4, and 5 the front guide plates 90 and 96 are not shown, although FIGS. 3–5 do show the upper inner flanges 156 that extend therefrom as well as the plates 160, and lower inner flanges 170 and the plates 178 connected thereto. Rear guide plates 92 and 98 likewise have flanges 172 welded to the inside thereof. Bolts 174 are threaded upwardly through the flanges 170 and 172, with the bolt ends secured to plates 178 and 180. A flat sandwich sheet 182 of plastic and metal with a low coefficient of friction is within the upwardly facing opening in plates 178 and 180 to abut the underside of slide plates 36 and 38. As can be best seen in FIG. 7, the front guide plate 96 with its associated upper and lower flanges 156 and 170 and the adjustable plates 160 and 178 forms or define a front C-clamp. Similarly, a back C-clamp is formed by the back guide plate 98 with its associated upper and lower flanges 158 and 172 and the adjustable plates 162 and 180. Similar C-clamps are formed from the front and back guide plates 90 and 92 which surround the wedge 32. The front and back C-clamps are adjusted using bolts 159 so that the upper plates 160 and 162 abut or are in contact with the upper surface of the ramps 40 and 42 and the lower plates 178 and 180 are adjusted using bolts 174 so that they are in contact with the lower surface of plates 36 and 38. The C-clamp plates 178 and 180 slide along the underside of slide plates 36 and 38, while the upper C-clamp plates 160 and 162 slide along the upper surface of ramps 40 and 42. The bolts 159 and 174 allow adjustability in the pressure applied by the C-clamp plates 160, 162, 178 and 180.

As stated above, when the wedges 32 and 34 are moved to the left by the cylinders 50 and 52, the ram 26 is moved toward the bed 24 by the interengagement or cooperation of the wedges 32 and 34 with the underside of ramps 40 and 42. When the wedges 32 and 34 are moved to the right by the cylinders 50 and 52, the ram 26 is moved upwardly away from the bed 24 by the interengagement or cooperation of the C-clamp plates 160 and 162 with the top surface of the ramps 40 and 42. That is, as the wedge is moved to the right, the C-clamp top plates 160 and 162 will be forced to move vertically as they ride along the top surface of the ramps 40 and 42. As can be appreciated, because the bottom plates 178 and 180 are operatively connected to the top plates 160 and 162 by the flanges and the guide plates, as the top plates 160 and 162 move vertically upwardly, the bottom plates 178 and 180 will also be moved vertically upwardly. Thus, the bottom plates will push the plates 36 and 38 upwardly as the wedge is moved to the right. As the plates 36 and 38 are connected to the ram 26, the ram 26 will be moved upwardly. Thus, essentially, the wedges are used to push the ram down and the C-clamps are used to pull the ram up.

Mounted to the upper edge of ram plate 126 to the left of each of the fixed wedges 150 and 152, from the perspective of FIGS. 1, 3–6 and 12, are pairs of dampening assemblies 190 and 192. The assemblies 190 and 192 are identical, so identical reference numbers are used for like parts. The assemblies 190 and 192 have a pair of triangular gib mounting plates 194. As seen more clearly for assembly 190 in the enlarged FIG. 12 drawing, each pair of plates 194 are secured as by welding to plates 196, respectively, that are in turn welded to the top of ram plate 124. Cross gib support plates 200 have their outsides secured as by welding to the top vertical edges of triangular plates 194. A pair of adjusting screws 204 are threaded through support plates 200 and bear into partial holes in gib plates 210 to adjustably mount plates 210. A pad of bearing material 214 is mounted to the outer surfaces fixed wedges 150 and 152 to abut the inside of the plates 210. When the machine 20 is operated, as will be explained below, the bearing material 214 slides relative to the plate 210. The aforesaid gib pads and plates 210 and 214, form a sliding interface which prevents forces from the horizontal movement of the ram from being transferred to the frame 22 of the machine 20 to reduce wear and tear, and disfigurement, of the machine components.

The cylinders 50 and 52 are shown to be of different diameter. For example, with a fifty ton press, cylinder 52 could be a 2.5 inch (6.35 cm.) diameter cylinder, and cylinder 52 could be a 4 inch (10.16 cm.) diameter cylinder. With this combination, the 2.5 inch (6.35 cm.) cylinder 52 could be employed for fast advance of the ram 26 from the FIG. 3 position to the FIG. 4 position which is just prior to the bending of the plate or sheet. From that point, both of the cylinders 50 and 52 could be employed for bending the sheet or plate. Many variations of cylinder size can be employed, and the cylinders 50 and 52 could be selected to be of the same size.

The cylinders 50 and 52 are fed by hydraulic pipes 226 (FIG. 1) which are connected to a hydraulic power source 228, as known in the art. Although a hydraulic power source has been illustrated, a pneumatic power source and pneumatic cylinders can also be used, a rotating screw with nut and free wheeling clutch may be employed to move each wedge, as can other suitable power and drive apparatus.

The nuts and bolts 108 and 110, as seen in FIGS. 7 and 8, extend through each of the front and rear link plates 104 and 106, through the front and rear guide plates 90 and 92, and 96 and 98 respectively, and through the respective wedges 32 and 34. As seen in FIG. 7, for wedge 34 and guide plates 96 and 98, the side plates 90 and 92, and 96 and 98, fit snugly against the sides of respective wedges 32 and 34. This prevents the wedges 32 and 34 from sliding away from engagement with all of the surfaces of their respective slide 36 and 38 and ramp 40 and 42. FIGS. 7 and 8 also show each wedge 32 and 34 having an upper recess which receives a flat sandwich sheet 240 of plastic and metal with a low coefficient of friction, and a lower recess which receives a flat sandwich sheet 242 of like material. The sheets 240 and 242 help to reduce friction between the wedges and their adjacent slides and ramps, to reduce wear and tear, and to provide smoother operation. Alternatively, rollers can be substituted for sheets 240 and 242. The total force applied to the ram may be increased or decreased by changing the slope of the wedges 32 and 34 during the design and manufacturing stages. The drive rods 72 and 74, as shown with regard to rod 72 in FIG. 9, have ends that extend within rectangular slots in wedges 32 and 34, and which can be secured to the wedges by welding.

Figure 11:
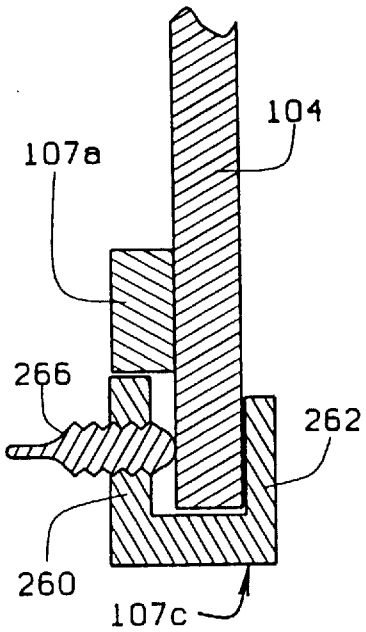
FIG. 11 is a section along the line 11—11 of FIG. 10.
Figure 10:
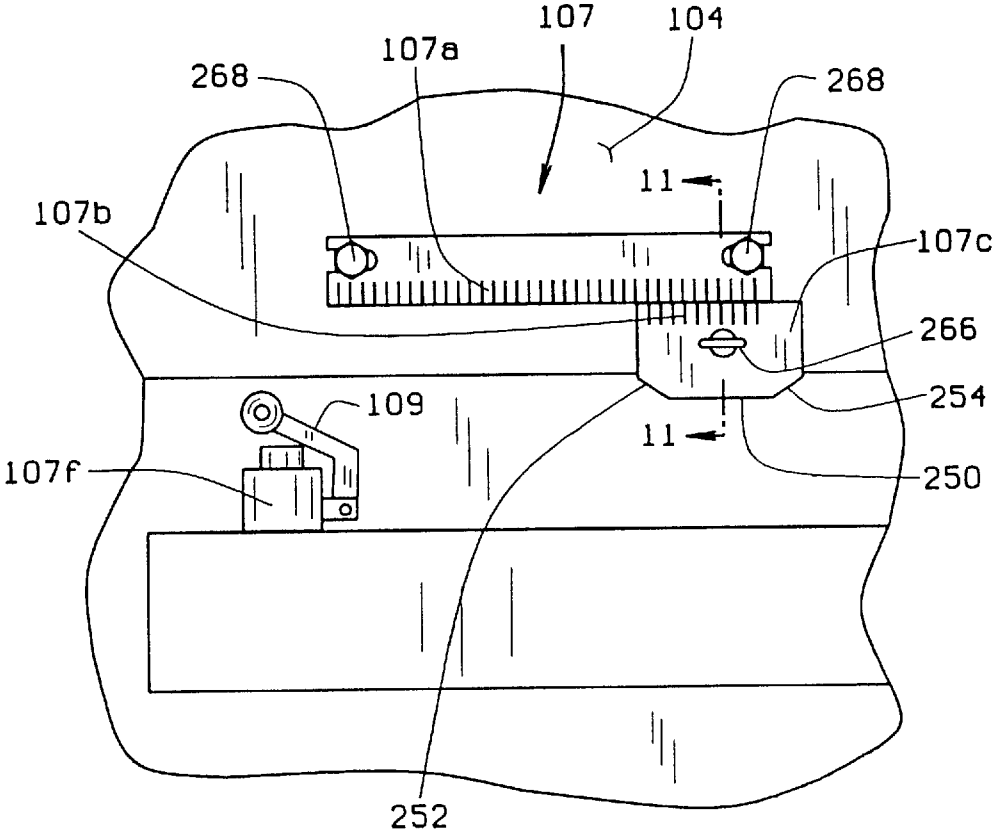
FIG. 10 is an enlarged view of the Vernier Scale arrangement shown in FIG. 1.
Figure 12:
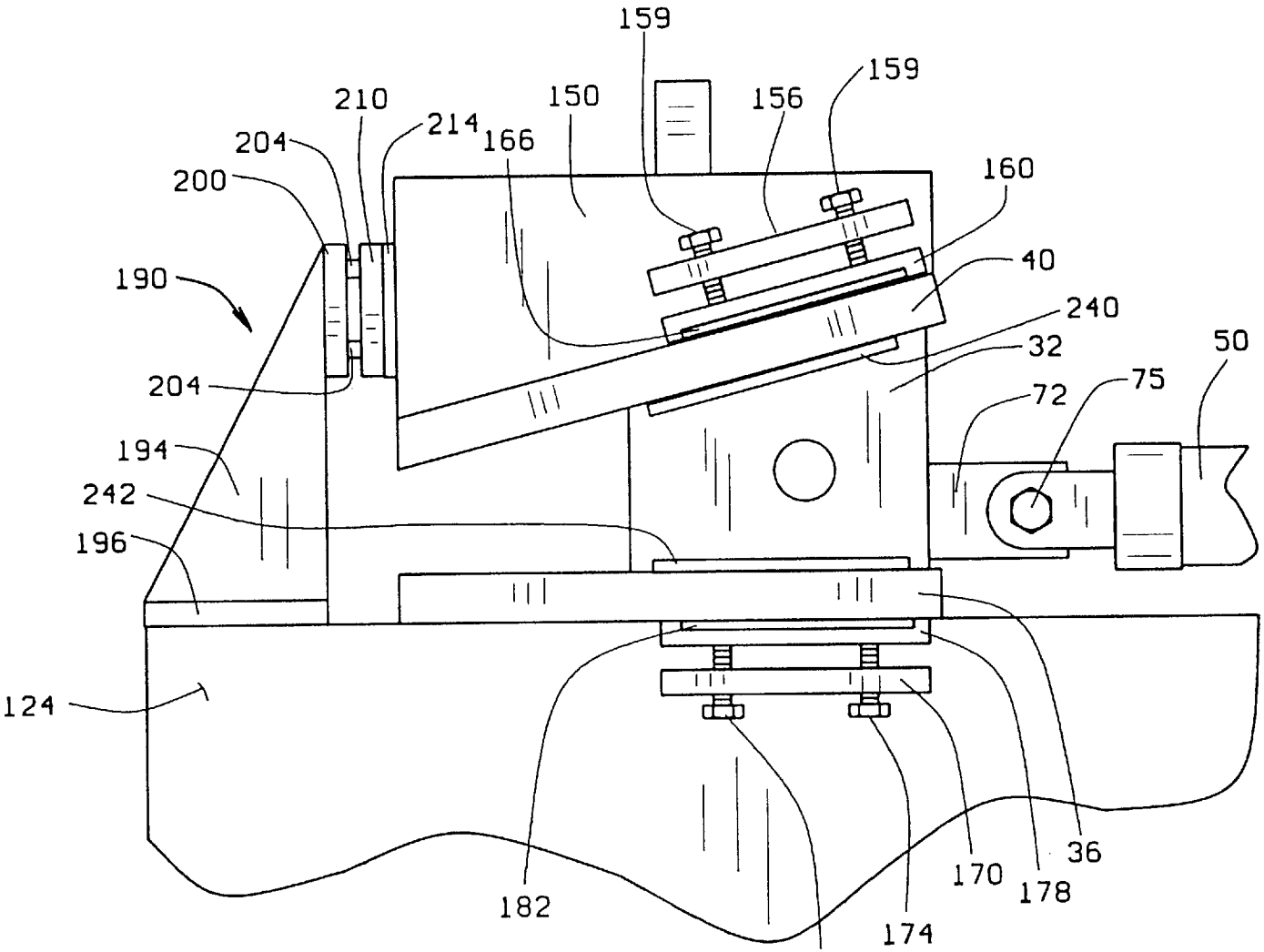
FIG. 12 is an enlarged view of part of the machine, showing the left wedge and the sliding plate assembly.

Referring now in more detail to the scale adjustment assembly 107, each of the cam plates 107*c*, 107*d* and 107*e*, as exemplified by cam plate 107*c* shown in the enlarged view of FIGS. 10 and 11, have a horizontal lower central edge 250 with a left slanted lower edge 252 and a right slanted edge 254 to the sides thereof. As shown in FIGS. 10 and 11 for cam plate 107*c*, the cam plates 107*c*, 107*d* and 107*e* each have a channel cross-section with flanges 260 and 262 extending on either side of link plate 104. An adjustable screw 266 extends through the front flange 260 to press against the surface of link plate 104 and thereby hold cam plate 107*c* in position. Scale plate 107*a* has slotted ends to receive bolts 268 that screw into bores in link plate 104 to hold scale 107*a* thereto. Looking at FIG. 10, the vertical markings of scale 107*b* on cam plate 107*c* and the vertical markings on scale 107*a* are spaced to allow positioning of the two scale components in Vernier Scale fashion. In the embodiment shown in FIGS. 1–12, the ratio of travel of link plate 104 (or wedges 32 and 34) relative to ram 26 is about 3.2 to 1. The vertical markings on scale components 107*a* and 107*b* are spaced according to such ratio. As noted earlier, the left switch 107*f* controls the point of downward penetration of the lower horizontal edge 127 of tooth punch 126 relative to the horizontal V-slot 120 of the female die of bed 24. Thus, by setting the position of scale 107*b* relative to the scale 107*a*, the point of the lower extension of horizontal ram tooth punch edge 127 is controlled. The horizontal scale arrangement shown for scale 107*a* and scale 107*b* allows for greater accuracy than with a vertically extending scale, since the scale arrangement takes advantage of the greater ratio of movement of the link plate 104 relative to the ram 26. This allows accurate and precision-like control of the point or extent of downward penetration of cam 26.

The other switches 107*g* and 107*h* also act to control ram movement. The engagement of cam plate 107*d* (the approach cam) with the arm of switch 107*g* stops the movement of ram 26 just before contact with the sheet or plate to be bent. The engagement of cam plate 107*e* with the arm of switch 107*h* activates that switch to stop the upward travel of ram 26. Suitable electrical circuitry connects the switches 107*f*, 107*g* and 107*h* to the power source 228, as known in the art, to activate and deactivate the power source 228 by engagement of the cam plates with the switch as aforesaid.

Figure 13:
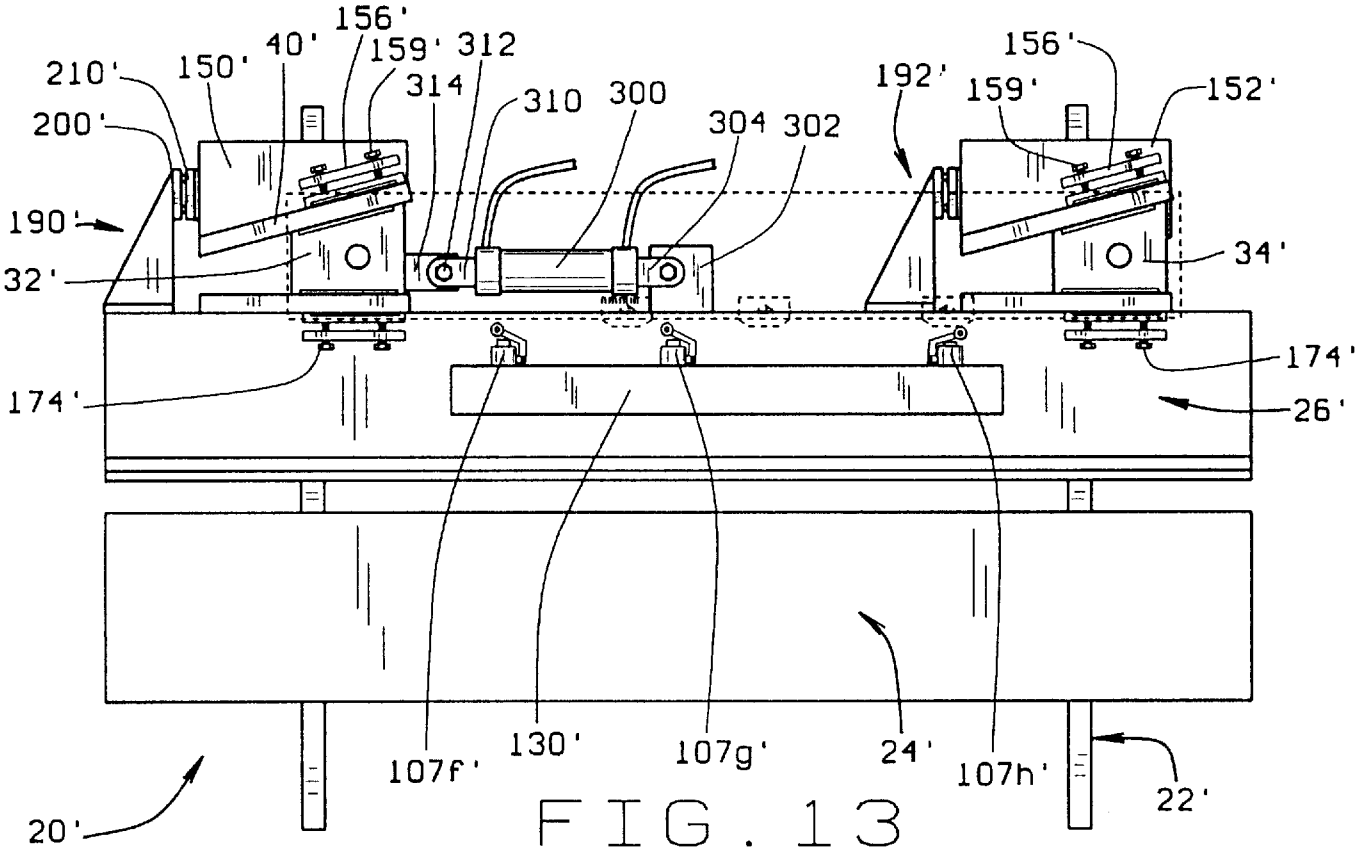
FIG. 13 is a front elevation of a second embodiment of the invention, showing a single cylinder press brake connected to the wedge assembly, with the front link plate and switch tabs shown in dashed lines, with the front guide plate and rear link plate not shown, and with the ram in a raised position.

Turning now to a description of the second embodiment shown in FIG. 13, a press brake machine 20' has a single hydraulic cylinder 300, as opposed to the dual hydraulic cylinder arrangement of FIGS. 1–12. The FIG. 13 embodiment shows a connecting plate 302 secured as by welding to the upper edge of ram 26'. Cylinder 300 has a member 304 extending from its right end which is secured as by a nut and bolt 306 to connecting plate 302. At the other end of cylinder 300 a drive member 310 slidingly extends to be connected by a nut and bolt 312 to a drive rod 314. Drive rod 314 is in turn connected to left side wedge 32' in the same fashion as demonstrated for the FIGS. 1–12 embodiment. The wedges 32' and 34' are drivingly connected to one another in the same fashion that wedges 32 and 34 are connected by the link plates illustrated as 104 and 106 in the FIGS. 1–12 embodiment. In FIG. 13 the outline of the front link plate 104' is shown in dashed lines, while the rear link plate 106' has the same position as link plate 104'. The single hydraulic cylinder 300 drives member 310 and drive rod 312 to move wedge 32' to and fro, with the linkage through the link plates 104' and 106' also driving wedge 34' to and fro equidistant to the wedge 32' movement. The wedges 32' and 34' slide along the slides 36' and 38' and ramps 40' and 42' in the same fashion as described for the FIG. 1–12 embodiment, to move ram 26' toward and away from bed 24'. The link plates 104' and 106', as with the FIGS. 1–12 embodiment, allow for equal application of force to the ends of the ram 26 and equal force across the ram tooth edge 127 during bending. Other components in FIG. 13 are given prime numbers corresponding to numbers for components in FIGS. 1–12. The FIG. 13 single cylinder embodiment can be preferable in situations where less variation in the power exerted relative to the ram is needed.

Figure 14:
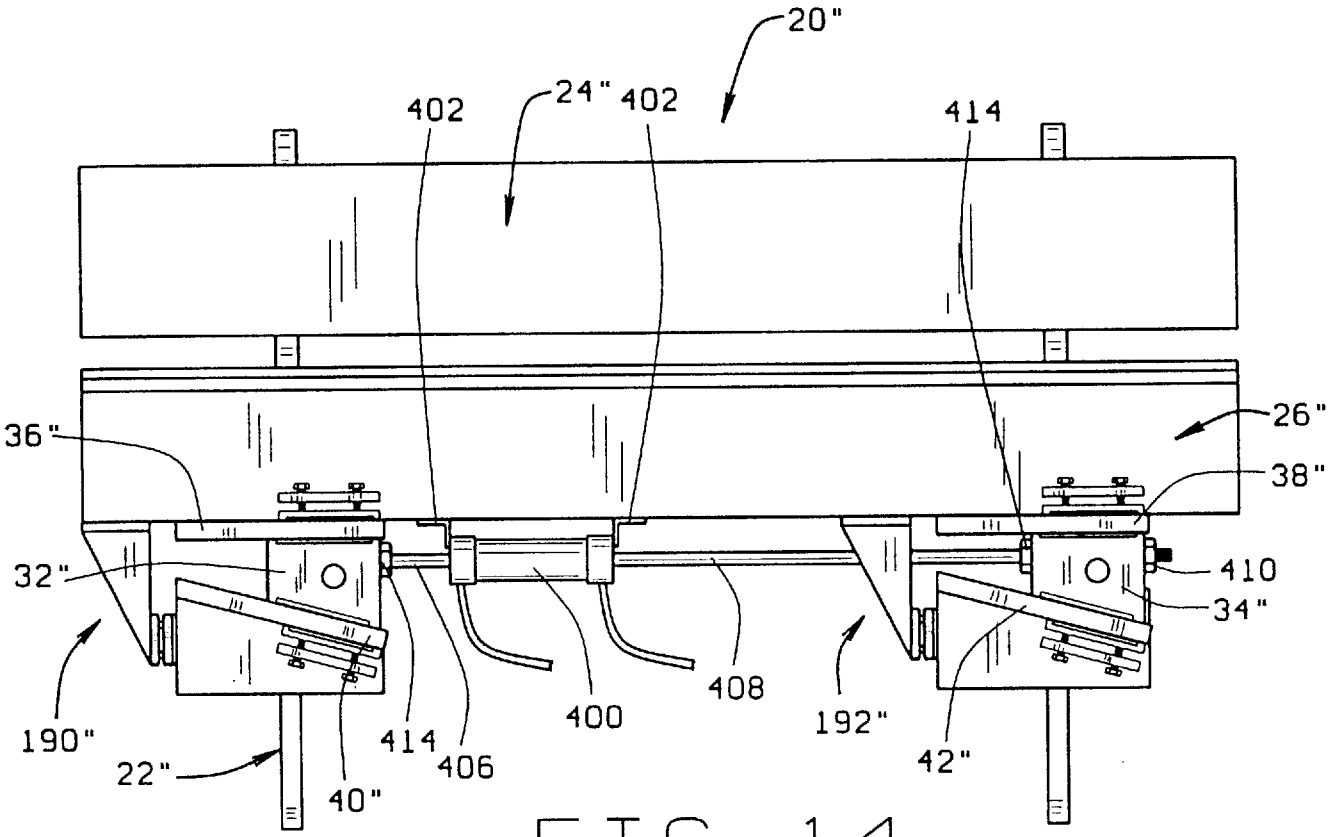
FIG. 14 is a front elevation of a third embodiment of the invention, showing a single cylinder press brake without the link plate, with the single cylinder shown having a shaft extending from each of its ends to be connected to a wedge, and with the wedge assembly mounted in a lower position to drive the ram upwardly toward the bed rather than downwardly as is FIGS. 1–12.

The FIG. 14 modification shows a press brake machine 20' wherein a single hydraulic cylinder 400 is used. The position of the ram 26" and bed 24" are reversed from that of the embodiments of FIGS. 1–12. The ram 26" is shown positioned beneath bed 24". The movement assembly 28" acts to drive the ram 26" upwardly to bend metal sheets and plates positioned between ram 26" and bed 24", and to move the ram 26" downwardly away from bed 24" to allow removal or repositioning of the bent sheets and plates.

The cylinder 400 has its ends secured to the underside of ram 26" by a pair of angle brackets 402 to hold cylinder 400 in fixed relationship to ram 26". Extending from both ends of cylinder 400 are drive rods 406 and 408. The end of rod 406 is threaded into the inner end of wedge 32" to drivingly move wedge 32". The outer end of rod 408 extends through wedge 34" and is secured by a bolt 410 threaded on the end of a rod 408. Collars 414 can be threaded around the drive rods 406 and 408 at the point in which they extend into wedges 32" and 34".

Figure 15:
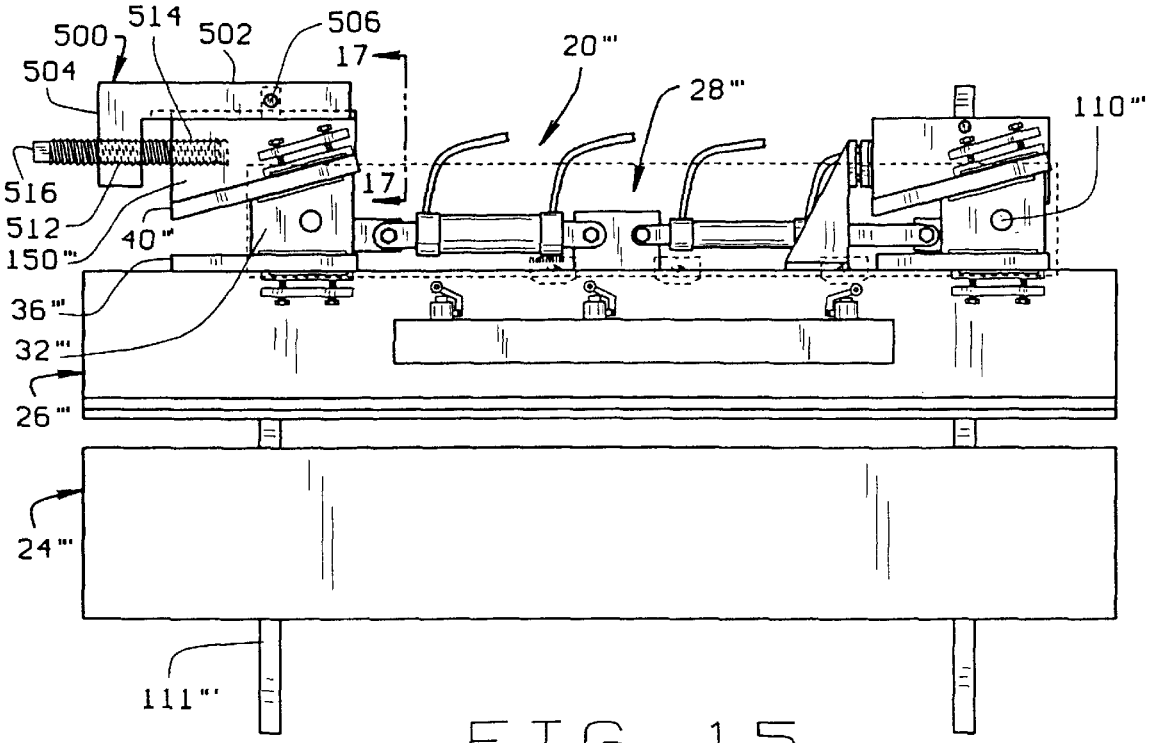
FIG. 15 is a front elevation of a fourth embodiment of the invention showing the frame adapted to enable the ram to be pivoted relative to the bed, the ram being shown in an unpivoted or level position to be parallel to the bed.
Figure 16:
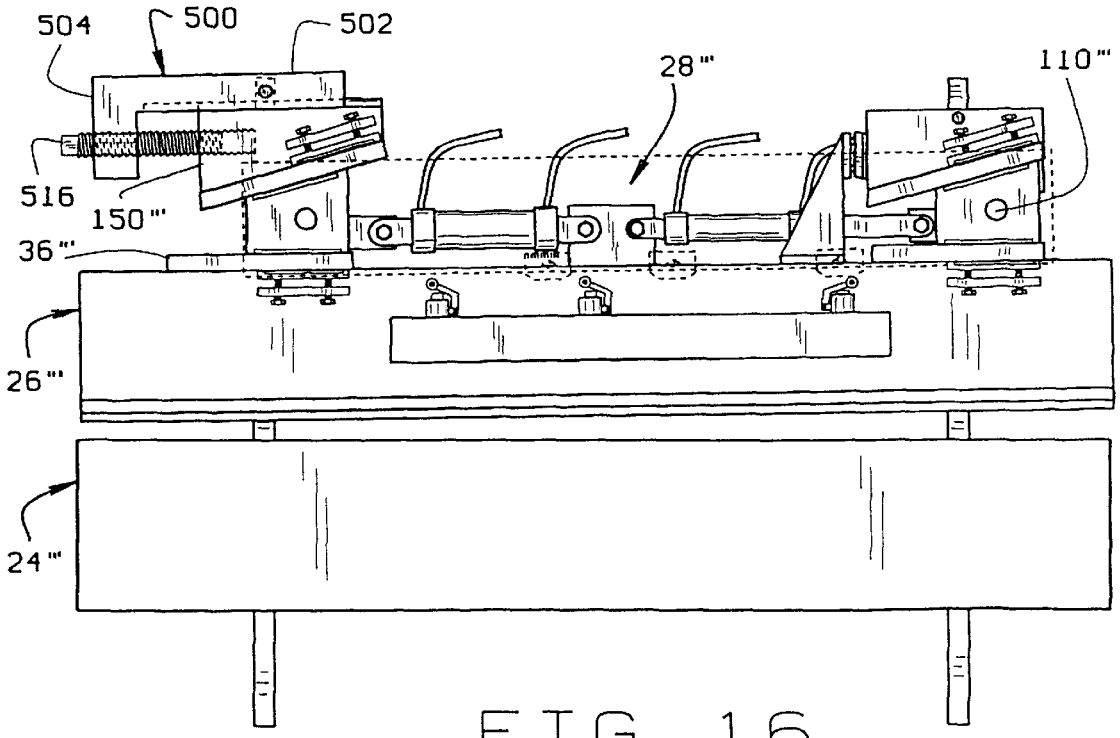
FIG. 16 is a front elevation of the invention of FIG. 15, the ram being shown in a pivoted position.
Figure 17:
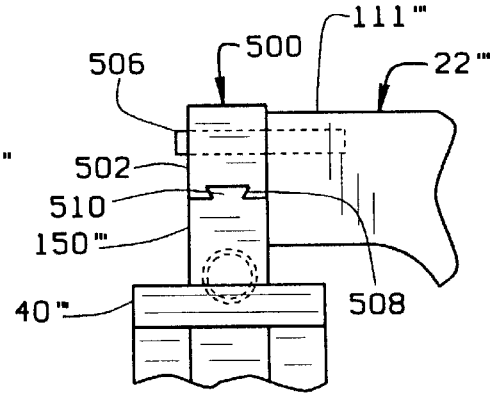
FIG. 17 is an enlarged fragmentary view of the attachment of a pivoting mechanism which pivots the ram.

FIGS. 15 and 16 show a press brake machine 20'" wherein the ram 26'" can be moved or pivoted relative to the frame 22'" to impart a slope to the ram 26'" so that the ram 26'" will be pivoted relative to the bed 24'". An L-shaped member 500 is secured to the upright 111'" of the frame 22'" above the wedge plate 150'". The L member 500 has an elongate first leg 502 which extends along the top of the wedge plate 150'" and a shorter leg 504 which extends downwardly, parallel to the outer surface of the wedge plate 150'". A bolt 506 passes through the first leg 502 into the upright 111'" to secure the L-member to the frame 22'". As seen in FIG. 17, the leg 502 has a dove-tail shaped groove 508 in its lower surface. The wedge plate 150'" has a corresponding dove-tail shaped tennon 510 on its upper surface which is slidingly received in the groove 508. Thus, whereas the wedge plates 150, 150' and 150" of the embodiments of FIGS. 1–14 are fixedly secured to the frame of the press brake machine, the wedge plate 150'" can be moved relative to the frame 22'" along a path which is parallel to the ram 26'" and which is defined by the tennon 510 and groove 508.

A threaded bolt hole 512 extends through the second leg 504 of the L-member, and a threaded bolt hole 514 is formed in the outer surface of the wedge plate 150'", the bolt holes 512 and 514 being coaxial with each other. A threaded bolt 516 passes through the bolt hole 512 of the L-member 500 to be received in the bolt hole 514 of the wedge plate 150'". In FIG. 15, the ram 26'" is shown to be generally parallel to the bed 24'". As can be seen by comparing FIGS. 15 and 16, when the bolt 516 is rotated, the bolt 516 will be threaded through the leg 504 of the L-member 500 to push the wedge plate 150'" to the right, as seen in FIG. 15. When the wedge plate 150'" is moved to the right, as seen in FIG. 16, so that the outer surface of the wedge plate 150'" is no longer co-planar with the outer surface of the slide plate 36'". When moved to the right, the wedge plate 150'" will interact with the wedge 32'", and cause the ram to pivot about the bolt 110'" on the opposite side of the ram 26'". This will narrow the gap between the ram 26'" and the bed 24'" at the left side of the press, but leave the gap between the ram and bed substantially unchanged at the right side of the press.

When the ram 26'" is set to a desired angle, the operation of the press brake 20'" is identical to the operation of the press brake 20 of FIGS. 1–12. Operation of the movement assembly 28'" is identical to that described above and the transmission of the downward force transmitted by the wedges will be transmitted between the two wedges, as described above, to maintain a constant pressure across the ram. However, because the left side of the ram 26'" is lower than the right side of the ram, with reference to FIGS. 15 and 16, the tooth punch of the ram will enter the die of the bed further on one side than on the other. This will enable the press brake machine to be used to make more types of bends in the sheet metal than it would be otherwise able to make if the press brake machine were limited to a parallel relationship between the ram 26'" and the bed 24'". For example, the press brake machine will be able to make fade-out type bends, which can not be made when the bed and ram are parallel.

Figure 18:
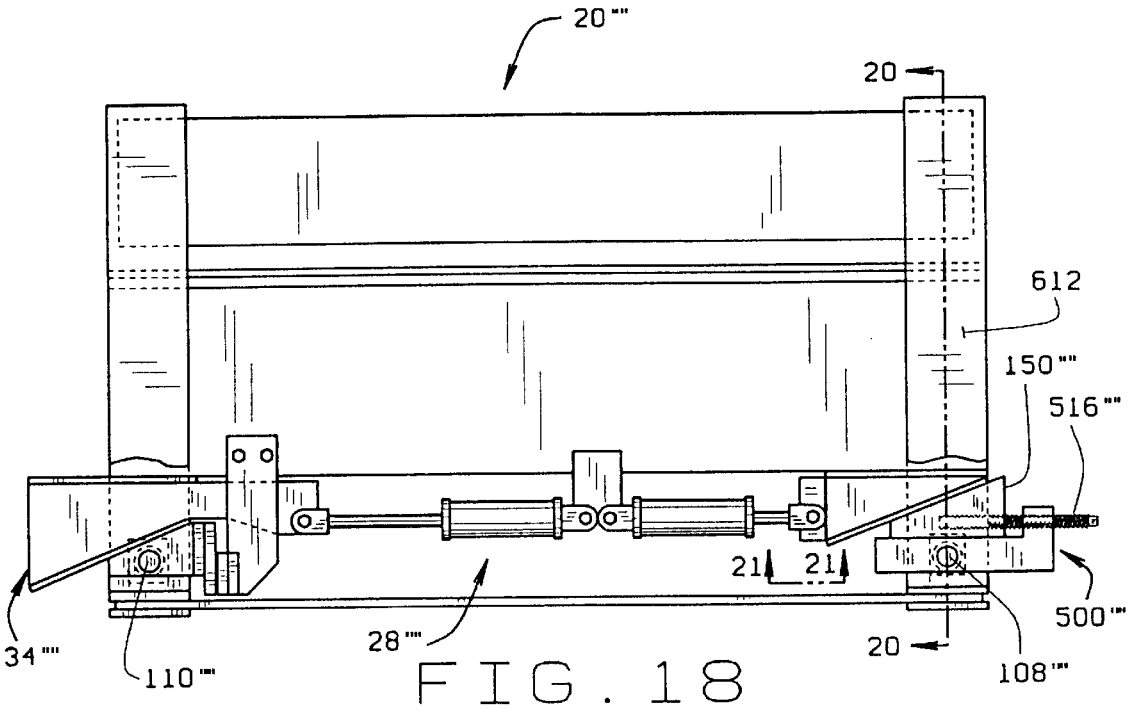
FIG. 18 is a front elevational view of a fifth embodiment of the invention, similar to the embodiment of FIG. 15, but wherein the ram is positioned below, rather than above, the bed, and wherein the ram is adapted to be pivoted relative to the bed, the ram being in an unpivoted, level position.
Figure 19:
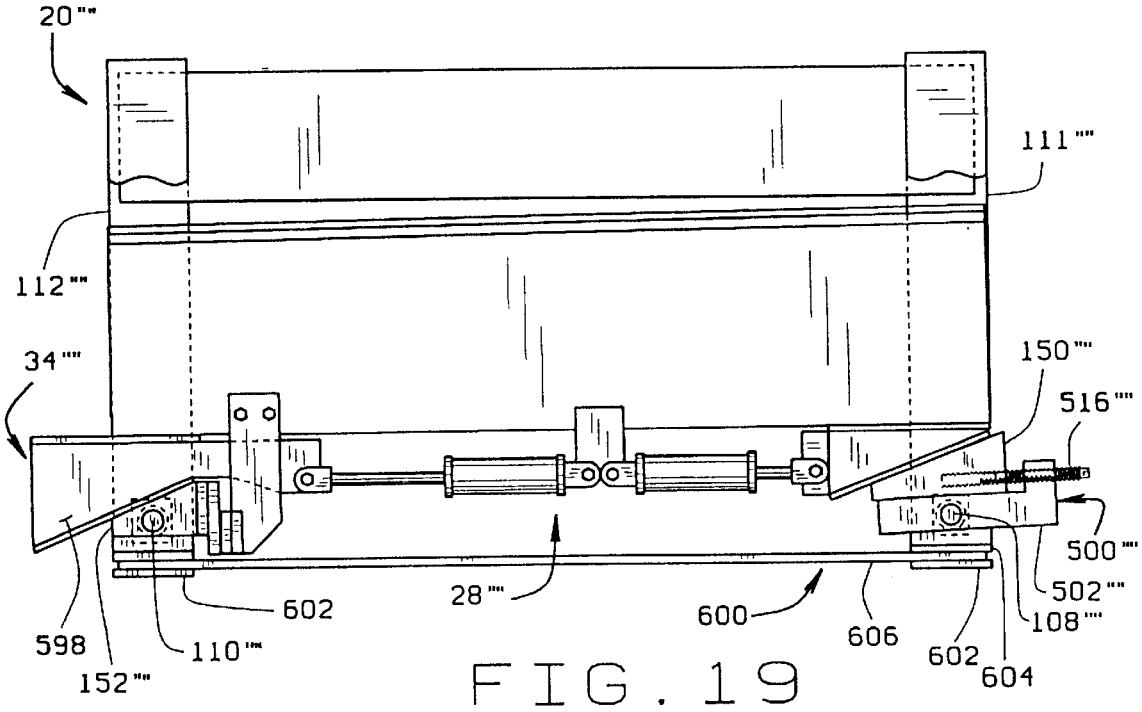
FIG. 19 is a front elevational view of the invention of FIG. 18 with the ram being shown in a pivoted position.

The press brake machine 20"" shown in FIGS. 18 and 19 is analogous to the press brake machine 20" shown in FIG. 14. In the press brake machine 20"" the position of the ram 26"" and bed 24"" are reversed from that of the embodiments of FIGS. 15–16. The ram 26"" is shown positioned beneath bed 24"". The movement assembly 28"" acts to drive the ram 26"" upwardly to bend metal sheets and plates positioned between ram 26"" and bed 24"", and to move the ram 26"" downwardly away from bed 24"" to allow removal or repositioning of the bent sheets and plates.

The press brake machine 20"" is provided with the L-shaped member 500"" to enable pivoting of the ram 26"" around the bolt 110"" relative to the bed 24"". As seen in FIG. 18, the ram 26"" and bed 24"" are shown in a parallel relationship, and in FIG. 19, the bolt 516"" of the ram pivoting member 500"" has been rotated to move the wedge plate 150"" laterally relative to the frame 22"".

As seen in FIGS. 18 and 19, the wedge 34"" is slightly modified and includes a portion 598 which extends beyond the outer surfaces of the frame 22"". This extension of the wedge 34"". is provided to accommodate the left-to-right movement of the wedge 34"" as the wedge 34"" is moved to the right (with reference to FIGS. 18 and 19) by the movement assembly 28"".

Figure 20:
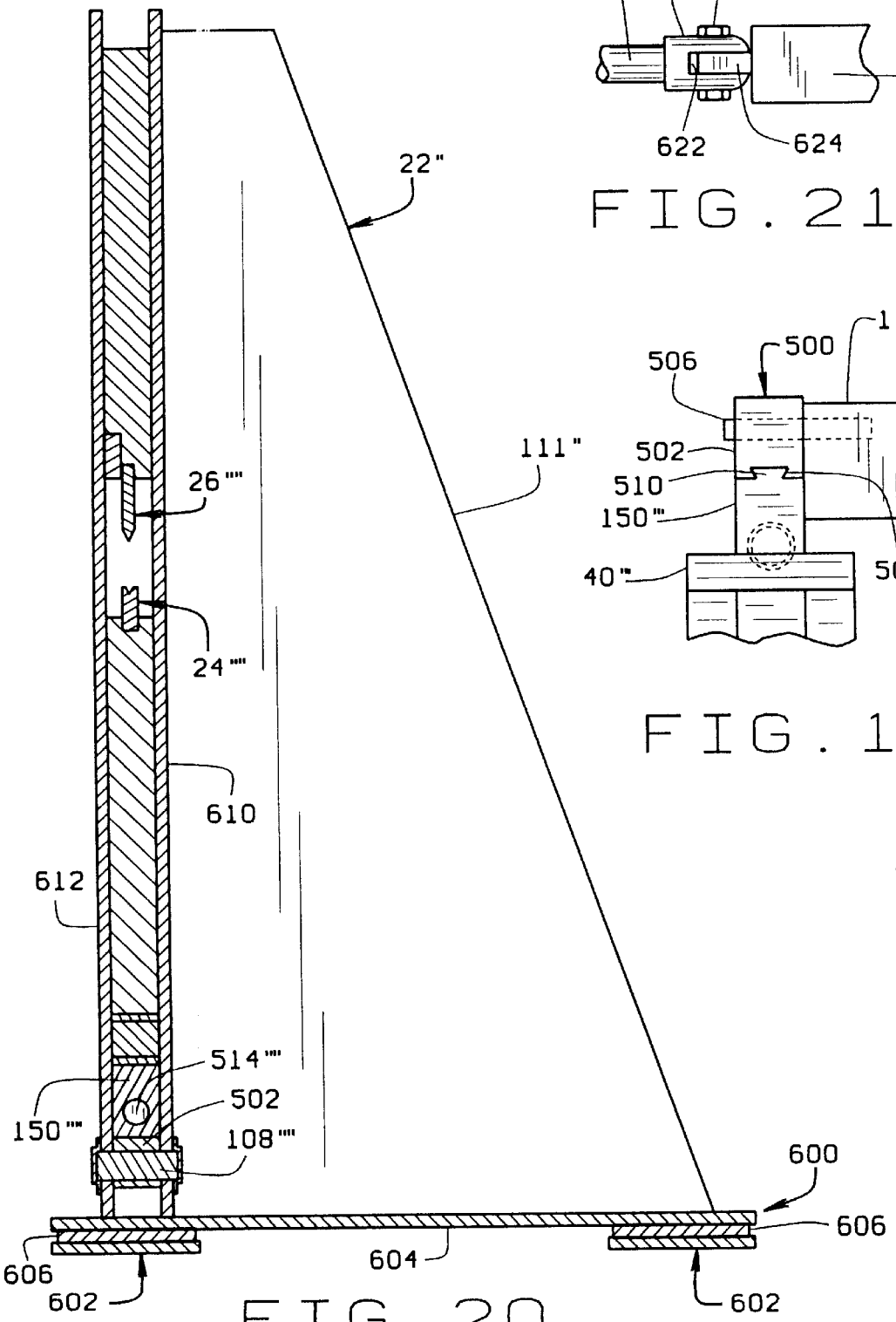
FIG. 20 is a cross-sectional view taken along line 20—20 of FIG. 18.

As can be seen in FIG. 20, the frame 22"" is slightly different from the frame 22 of FIGS. 1–12. The frame 22"" comprises a base plate 600 which rests on four feet 602. A pair of uprights 111"" and 112"" extend upwardly from opposite sides of the base 600. The base 600 comprises right and left members 604 upon which the uprights 111"" and 112"" stand. Front and back cross-members 606 extend between the right and left members 604 beneath the left and right members 604 to connect the uprights 111"" and 112"". The feet 602 are mounted to the underside of the cross-members 606. The uprights 111"" and 112"" are preferably right triangular and have a generally vertical front edge. A back guide plate 610 is mounted, as by welding, to the front edge of each upright 111"" and 112"" and a front guide plate 612 extends upwardly from the base 600 spaced forwardly from the back guide plate 610. The front and back guide plates 612 and 610 sandwich the ram 26"" and the bed 24"" to guide the upward and downward movement of the ram 26"". Unlike the guide plates 90, 92, 96, and 98 of the press brake 20 of FIGS. 1–12, the guide plates 610 and 612 extend the height of the press brake. That is, they extend from the top of the base 600 to the top of the ram 26"". The front and back plates 612 and 610 are interconnected by the bolts 108"" which extends through the arm 502"" of the ram pivoting member 500"". The plates 610 and 612 on the opposite side of the press brake machine from the pivoting mechanism 500"" are connected by the bolt 110"". Because the plates 610 and 612 are operably connected to the wedge plates 150"" and 152"", the plates 610 and 612 will transfer the forces generated by each of the cylinders of the movement assembly 28"" in the same manner as the front and back guide plates 96 and 98 of FIGS. 1–12. Thus, the pressure applied across the ram 26"" will be constant and equal over the length of the ram when the ram 26"" is parallel to the bed 24"". As noted above, when the ram is pivoted relative to the bed by the ram pivoting assembly 500"", the punch tooth enters the die further on one end than on the other, resulting in a fade-out type bend.

Figure 21:
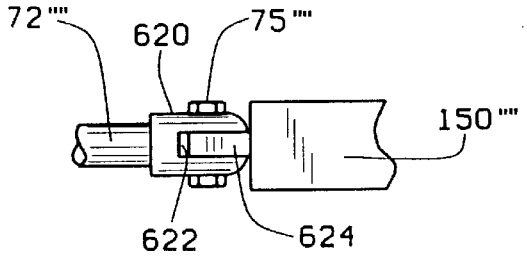
FIG. 21 is an enlarged fragmentary view taken along line 21—21 of FIG. 18.

The connection of the wedge plate 150"" to the piston rod 72"" of the cylinder of the drive mechanism 28"" is shown in FIG. 21. The piston rod 72"" has a block 620 at its end with an inwardly extending slot 622. The wedge plate 150"" has a finger 624 which extends therefrom to be received in the slot 622. A nut and bolt 75"" passes through the block 620 and the wedge block finger 624 to secure the wedge block 150"" to the piston rod or drive shaft 72"".

In the embodiment of FIGS. 1–12, the inclined ramps 40 and 42 are shown mounted to the frame, while the horizontal slides 36 and 38 are shown mounted to the ram. This is considered preferable for the FIG. 1–12 embodiment, because of the greater convenience and ease in mounting the horizontal slides 36 and 38 to the horizontal upper edge of ram plate 124. However, if desired, inclined ramps could be mounted to the ram, and the horizontal slides could be mounted on the frame. Likewise in the embodiments of FIGS. 13 and 14, the slanted ramps could be mounted to the ram and the horizontal slides could be mounted to the frame.

Although a hydraulic cylinder arrangement has been illustrated, pneumatic cylinders, or other drive actuators such as a nut and screw drive, could be employed. A power source other than the hydraulic power source 228, such as pneumatic, electrical motor or solenoid or the like could be used. Similarly, although a bolt has been shown to move the wedge plate 150'" to pivot the ram 26'", the bolt may be replaced with any other linear motion device, such as a hydraulic or pneumatic cylinder, or a nut and screw drive. Further, although the bolt 516 has been shown to be screwed into the wedge plate 150'", the bolt could be connected to the wedge plate 150'" in any other conventional manner, such as by the use of a connector on the outer surface of the wedge plate which would permit the bolt to rotate to move the first wedge plate both toward and away from the second wedge plate.

Various other modifications apparent to those with ordinary skill in the art can be made to the aforementioned disclosure of preferred embodiments without departing from the spirit of the invention, which is limited only by the following claims.

What is claimed is:

1. A machine for bending sheets and plates of metal comprising:

(a) a frame;

(b) a bed mounted to the frame;

(c) a ram movably mounted to the frame to be moved toward and away from the bed;

(d) an assembly for moving the ram toward and away from the bed to bend sheets and plates of metal placed between the bed and the ram, comprising:

(i) a first wedge and a second wedge mounted to slide relative to the frame and in sliding relationship to the ram; each said wedge having an inclined surface; the sliding relationship of each wedge relative to one of the ram or the frame being along said inclined surface;

(ii) first and second ramp members mounted to one of the ram or bed; said first and second ramp members having first and second opposed inclined surfaces, said ramp members being positionally fixed relative to the frame during movement of the ram; the first and second ramp members being positioned to correspond to the first wedge and second wedge, respectively; said first inclined surfaces of the first and second ramp members being in sliding contact with the inclined surfaces of said first and second wedges, respectively; the first and second wedges being slidable in first and second directions along the first and second ramp members, respectively, (iii) first and second clamp members mounted to slide relative to said frame with said first and second wedges, respectively, said clamp members each having a first portion and a second portion, said first and second portions being interconnected; said first portion comprising a plate positioned to be in sliding contact with the second inclined surface of said ramp member, said second portion being operatively connected to said ram to be slidable relative to said ram; and (iv) an actuator located between the first and second wedges to move said first and second wedges and said first and second clamp members in said first and second direction, whereby when said actuator moves said wedges and said clamp members in said first direction, said wedges interact with said ramp members to move said ram toward said bed and when said actuator moves said wedges and said clamp members in said second direction, said clamp members interact with said ramp members to move said ram away from said bed.

2. The metal sheet and metal plate bending machine of claim 1, wherein the actuator comprises first and second hydraulic cylinders both of which are positioned between the wedges, each cylinder having an inner end, each said inner end being mounted to one of the ram or the frame, each cylinder having a second outer drive member, the first and second drive members of the cylinders being connected in association with the first and second wedges respectively, so that the first and second cylinders can be actuated to cause the first and second drive members to move the first and second wedges relative to the first and second cylinders.

3. The metal sheet and metal plate bending machine of claim 2, wherein there is a connecting member mounted to the ram, and the inner ends of the first and second cylinders are mounted to the connecting member of the ram.

4. The metal sheet and metal plate bending machine of claim 1, wherein the actuator comprises a hydraulic cylinder positioned between the first and second wedges, one end of the cylinder being mounted to one of the ram or the frame, and the other end of said cylinder having a drive member connected to be associated with the first wedge, said first wedge being drivingly connected to the second wedge so that when the actuator slides the first wedge horizontally in the first direction the second wedge is driven to horizontally slide a distance that is equidistant to the distance traveled by the first wedge.

5. The metal sheet and metal plate bending machine of claim 1, wherein the actuator comprises a hydraulic cylinder located between the first and second wedges, the hydraulic cylinder having a first end and an oppositely facing second end, first and second drive members extending from the first and second ends of the cylinder, said drive members being connected to the hydraulic cylinder to move horizontally away from and toward the cylinder, the first and second drive members being drivingly associated with the first and second wedges, respectively, to drive the wedges horizontally in a first direction along the first and second ramps and in the second direction along the first and second ramps.

6. The metal sheet and metal plate bending machine of claim 1, wherein the ram has a punch tooth, and the first and second ramps comprise plates mounted to extend at an angle relative to the horizontal punch tooth edge of the ram.

7. The metal sheet and metal plate bending machine of claim 1, wherein the first and second wedges each have an angled side that faces the ramp plates to slide in first and second directions relative to the ramp plates.

8. The metal sheet and metal plate bending machine of claim 1, further comprising first and second pairs of guide plates, the first pair of guide plates mounted on the sides of the first wedge and on the outside of the first ramp to move with the first wedge; and the second pair of guide plates being mounted on the sides of the second wedge and on the outside of the second ramp to move with the second wedge, said clamp members comprising said guide plates, said guide plates interconnecting said first and second portions of said clamp members.

9. The metal sheet and metal plate bending machine of claim 1, further comprising a pivoting mechanism for pivoting said generally horizontal edge of said ram about a pivot axis relative to said bed.

10. The metal sheet and metal plate bending machine of claim 9 wherein a bolt passes through the second wedge, said pivot axis comprising said bolt; said pivot mechanism comprising a mounting assembly for adjustably mounting said first ramp member to said frame such that the horizontal position of said first ramp member can be selectively set prior to movement of said ram, and a linear motion device operably connected between said frame and the first ramp member to move said first ramp member in first direction towards said second ramp member and in a second direction away from said second ramp member; whereby horizontal movement of said first ramp member relative to said second ramp member causes said first ramp member to move horizontally relative to said first wedge and causes said ram to pivot about said pivot axis.

11. The metal sheet and metal plate bending machine of claim 10 wherein first ramp member includes a substantially horizontal surface opposite its angled surface; said mounting assembly for mounting said first ramp member to said frame comprises a horizontal member adjacent said horizontal surface of said first ramp member; said first ramp member being slidably mounted to said horizontal member.

12. The metal sheet and metal plate bending machine of claim 11 wherein said horizontal member has one of a groove and a tennon in a surface adjacent said first ramp member horizontal surface, and said ramp member has another of said groove and tennon in its horizontal surface; said tennon and groove being complimentary shaped, said tennon being slidably received in said groove.

13. The metal sheet and metal plate bending machine of claim 11 wherein said linear motion device includes a bolt, said pivoting mechanism including a leg extending generally parallel to said outer surface of the first ramp member, said bolt extending through said leg and being connected to the first ramp member, whereby rotation of said bolt in a first direction moves said first ramp member in said first direction and rotation of said bolt in a second, opposite, direction, moves said ramp member in said second direction.

14. A machine for bending sheets and plates of metal comprising:

(a) a frame;

(b) a bed mounted to the frame;

(c) a ram movably mounted to move vertically up and down relative to the frame, the ram having a generally horizontally extending edge so that the horizontal edge can be moved vertically toward the bed to bend a metal sheet or plate located between the bed and the horizontal edge of the ram;

(d) an assembly for moving the ram vertically toward and away from the bed to bend sheets and plates of metal placed between the bed and the horizontal edge of the ram, comprising:

(i) a first wedge and a second wedge mounted to slide horizontally relative to the frame and in horizontal sliding relationship to the horizontal edge of the ram, with the sliding relationship of each wedge relative to one of the ram or the frame being along an inclined surface;

(ii) first and second ramp members mounted to one of the ram or bed; said first and second ramp members being positionally fixed relative to the frame during movement of the ram; the first and second ramp members being positioned to correspond to the first wedge and second wedge, respectively; each of the first and second ramp members having a first substantially flat angled surface that faces its corresponding wedge, the first and second wedges each having a substantially flat angled surface that faces the first surface of its corresponding ramp member, so that the first and second wedges can slide in first and second directions along the first and second ramp members, respectively, so that when the wedges are moved horizontally in one of said first and second directions relative to the ramp members, the ram is moved vertically relative to the bed to bend sheets and plates of metal positioned between the bed and the horizontal edge of the ram; and (iii) an actuator located between the first and second wedges, with means for connecting the actuator to the first and second wedges to drive the wedges horizontally relative to the frame in first and second directions along the first and second ramps respectively; and (e) means for setting and controlling downward movement of the ram relative to the bed, comprising a Vernier scale assembly aligned generally horizontally relative to the ram, wherein the Vernier scale assembly has two scale components, the first component being mounted to extend generally horizontally and in general alignment with the direction of movement of the first wedge and second wedge during sliding of the wedges, and the second scale assembly component also extending generally horizontally and in alignment with the direction of movement of the first and second wedges during sliding, the second component being adjustable relative to the position of the wedges, each scale component having markings thereon permitting selection of alignment of the markings of the first component with the markings of the second component to set the position of movement of the ram relative to the bed.

15. A machine for bending sheets and plates of metal comprising:

(a) a frame;

(b) a bed mounted to the frame;

(c) a ram movably mounted to move relative to the frame, the ram having an edge that can be moved toward the bed to bend a metal sheet or plate located between the bed and the edge of the ram;

(d) an assembly for moving the ram toward and away from the bed to bend sheets and plates of metal placed between the bed and the edge of the ram, comprising:

(i) a first wedge and a second wedge mounted to slide relative to the frame and in sliding relationship to the edge of the ram, with the sliding relationship of each wedge relative to one of the ram or the frame being along an inclined surface;

(ii) first and second ramp members mounted to one of the ram or bed; said first and second ramp members being positionally fixed relative to the frame during movement of the ram; the first and second ramp members being positioned to correspond to the first wedge and second wedge, respectively; each of the first and second ramp members having a first substantially flat angled surface that faces its corresponding wedge, the first and second wedges each having a substantially flat angled surface that faces the first surface of its corresponding ramp member, so that the first and second wedges can slide in first and second directions along the first and second ramp members, respectively, so that when the wedges are moved in one of said first and second directions relative to the ramp members, the ram is moved relative to the bed to bend sheets and plates of metal positioned between the bed and the edge of the ram; and (iii) an actuator located between the first and second wedges, with means for connecting the actuator to the first and second wedges to drive the wedges relative to the frame in first and second directions along the first and second ramps respectively; and (e) dampening means for substantially preventing the force from the movement of the first and second wedges from being transferred to the frame; said dampening means comprising at least one dampening assembly, said at least one dampening assembly comprising a gib plate operatively mounted to the ram to be in sliding contact with the first fixed wedge such that force applied by the first wedge to the first ramp member is transferred to the dampening assembly.

16. A machine for bending sheets and plates of metal comprising:

(a) a frame;

(b) a bed mounted to the frame;

(c) a ram movably mounted to the frame, the ram having a punch tooth with a horizontal edge;

(d) an assembly for moving the ram toward and away from the bed to bend sheets and plates of metal placed between the bed and the ram, comprising:

(i) a first wedge and a second wedge mounted to slide relative to the frame and in sliding relationship to the ram, with the sliding relationship of each wedge relative to one of the ram or the frame being along an inclined surface;

(ii) first and second ramp members mounted in fixed relationship to one of the ram or bed and positioned so that the first and second wedges can slide in first and second directions along the first and second ramp members, respectively, so that when the wedges are moved in one of said first and second directions relative to the ramp members, the ram is moved toward the bed to bend sheets and plates of metal positioned between the bed and the ram, the first and second ramp members comprising plates mounted to extend at an angle relative to the horizontal punch tooth edge of the ram, the first and second wedges each have an angled side that faces the ramp plates to slide in first and second directions relative to the ramp plates;

(iii) first and second pairs of guide plates, the first pair of guide plates mounted on the sides of the first wedge and on the outside of the first ramp; and the second pair of guide plates being mounted on the sides of the second wedge and on the outside of the second ramp;

(iv) an actuator located between the first and second wedges, with means for connecting the actuator to the first and second wedges to drive the wedges in first and second directions along the first and second ramps respectively;

(e) means for setting and controlling movement of the ram toward the bed comprising a Vernier scale assembly aligned generally horizontally relative to the ram, the assembly having two scale components, the first component being mounted in association with the link plate to extend generally horizontally and in general alignment with the direction of movement of the first wedge and second wedges, and the second scale assembly component mounted in association with the link plate and with a cam plate and also extending generally horizontally and in alignment with the direction of movement of the first and second wedges during sliding, the cam plate being adjustably mounted to the link plate, each scale component having markings thereon permitting selection of alignment of the markings of the first component with the markings of the second component to set the stop position of movement of the ram relative to the bed, and a control switch associated with the ram, the switch having means for interacting with the cam to be actuated to stop movement of the ram toward the bed.

17. A machine for bending sheets and plates of metal comprising:

(a) a frame;

(b) a bed mounted to the frame;

(c) a ram movably mounted to the frame;

(d) an assembly for moving the ram toward and away from the bed to bend sheets and plates of metal placed between the bed and the ram, comprising:

(i) a first wedge and a second wedge mounted to slide relative to the frame and in sliding relationship to the ram, with the sliding relationship of each wedge relative to one of the ram or the frame being along an inclined surface;

(ii) first and second ramp members mounted in fixed relationship to one of the ram or bed and positioned so that the first and second wedges can slide in first and second directions along the first and second ramp members, respectively, so that when the wedges are moved in one of said first and second directions relative to the ramp members, the ram is moved relative to the bed to bend sheets and plates of metal positioned between the bed and the ram; and (iii) an actuator located between the first and second wedges, with means for connecting the actuator to the first and second wedges to drive the wedges in first and second directions along the first and second ramps respectively; and (e) means for setting and controlling downward movement of the ram relative to the bed, comprising a Vernier scale assembly aligned generally horizontally relative to the ram, wherein the-assembly has two scale components, the first component being mounted to extend generally horizontally and in general alignment with the direction of movement of the first wedge and second wedge during sliding of the wedges, and the second scale assembly component also extending generally horizontally and in alignment with the direction of movement of the first and second wedges during sliding, the second component being adjustable relative to the position of the wedges, each scale component having markings thereon permitting selection of alignment of the markings of the first component with the markings of the second component to set the position of movement of the ram relative to the bed.

18. The metal sheet and metal plate bending machine of claim 17, further comprising a link plate connecting the first and second wedges, the first scale component being mounted to move with the link plate, a cam plate with the second scale component thereon, the cam plate being adjustably mounted to the link plate, and a control switch associated with the ram, the switch having means for interacting with the cam to be actuated to stop downward movement of the ram relative to the bed.

19. A machine for bending sheets and plates of metal comprising:

(a) a frame;

(b) a bed mounted to the frame;

(c) a ram movably mounted to move vertically up and down relative to the frame, the ram having a horizontally extending edge with a horizontally extending punch tooth so that the horizontal punch tooth can be moved vertically toward the bed to bend a metal sheet or plate located between the bed and the horizontal punch tooth;

(d) an assembly for moving the ram vertically toward and away from the bed to bend sheets and plates of metal placed between the bed and the horizontal punch tooth of the ram, comprising:

(i) a first wedge and a second wedge mounted to slide horizontally relative to the frame and in horizontal sliding relationship to the horizontal edge of the ram, with the sliding relationship of each wedge relative to one of the ram or the frame being along an inclined surface;

(ii) first and second ramp plates mounted in fixed relationship to one of the ram or bed, the first and second ramp plates positioned to correspond to the first wedge and second wedge, respectively, the first and second ramp plates each having a first substantially flat angled surface that faces its corresponding wedge and a second angled surface that faces away from its corresponding wedge, the first and second wedges each having a substantially flat angled surface that faces the first surface of its corresponding ramp plate, so that the first and second wedges can slide in first and second directions along the first and second ramp plates, respectively, so that when the wedges are moved horizontally in one of said first and second directions relative to the ramp plates, the ram is moved relative to the bed to bend sheets and plates of metal positioned between the bed and the horizontal edge of the ram;

(iii) first and second pairs of guide plates, the first pair of guide plates mounted on opposite sides of the first wedge and on the outside of the first ramp plate to move horizontally with the horizontal movement of the first wedge; and the second pair of guide plates being mounted on opposite sides of the second wedge and on the outside of the second ramp plate to move horizontally with the horizontal movement of the second wedge;

(iv) a link member connecting the first wedge to the second wedge and connecting the first pairs of guide plates to the second pair of guide plates, so that the movement of the first wedge transfers force to the second wedge to move the second wedge horizontally in the same direction and same distance as the first wedge;

(v) each pair of guide plates having a guide member extending horizontally from at least one of the guide plates of each guide plate pair, so that each guide member is positioned to face the second inclined surface of its corresponding ramp plate, so that each guide member can slide along the said second surface of the ramp plate when the ram and its horizontal punch tooth move in a vertical direction; and (vi) an actuator located between the first and second wedges, with means for connecting the actuator to the first and second wedges to drive the wedges horizontally relative to the frame in first and second directions along the first and second ramps respectively.

20. The metal sheet and metal plate bending machine of claim 19, further comprising first and second slide plates mounted in fixed relationship to the one of the ran or bed to which the ramp plates are not mounted, so that the first and second wedges are located between a first ramp plate and a first slide plate and a second ramp plate and a second slide plate, respectively, each slide plate having a first substantially flat surface facing the wedge and each slide plate having a second substantially flat surface facing opposite the first slide plate surface; each pair of guide plates having a second guide member extending horizontally from at least one of the guide plates forming each guide plate pair so that each said second guide member is positioned to face the second surface of the slide plate, so that each second guide member can slide along the said second slide plate surface when the ram and its horizontal punch tooth move in a vertical direction.

21. The metal sheet and metal plate bending machine of claim 19, further comprising first and second sliding assemblies spaced horizontally from one another, each sliding assembly comprising a first component mounted in connection with the ram to move vertically with vertical movement of the ram, with bearing material positioned between such component and structure mounted with the frame, with horizontal force applied by the first wedge to the first ramp plate transferred to the first sliding assembly, and horizontal force applied by the second wedge to the second ramp plate transferred to the second sliding assembly, the sliding assemblies substantially preventing the force from the horizontal movement of the first and second wedges from being transferred to the frame.

22. A machine for bending sheets and plates of metal comprising:

(a) a frame;

(b) a bed mounted to the frame;

(c) a ram movably mounted to the frame, the ram having a generally horizontal edge;

(d) an assembly for moving the ram toward and away from the bed to bend sheets and plates of metal placed between the bed and the ram, comprising:

(i) a first wedge and a second wedge mounted to slide relative to the frame and in sliding relationship to the ram, with the sliding relationship of each wedge relative to one of the ram or the frame being along an inclined surface;

(ii) first and second ramp members mounted to one of the ram or bed and positioned so that the first and second wedges can slide in first and second directions along the first and second ramp members, respectively, so that when the wedges are moved in first and second directions relative to the ramp members, the ram is moved relative to the bed to bend sheets and plates of metal positioned between the bed and the ram; and (iii) an actuator located between the first and second wedges, the actuator being operably connected to the first and second wedges to drive the wedges in first and second directions along the first and second ramps respectively; and (e) a pivoting mechanism for pivoting said generally horizontal edge of said ram about a pivot axis relative to said bed.

23. The metal sheet and metal plate bending machine of claim 22 wherein a bolt passes through the second wedge, said pivot axis comprising said bolt; said pivot mechanism comprising a mounting assembly for adjustably mounting said first ramp member to said frame such that the horizontal position of said first ramp member can be selectively set prior to movement of said ram, and a linear motion device operably connected between said frame and the first ramp member to move said first ramp member in first direction towards said second ramp member and in a second direction away from said second ramp member; whereby horizontal movement of said first ramp member relative to said second ramp member causes said first ramp member to move horizontally relative to said first wedge and causes said ram to pivot about said pivot axis.

24. The metal sheet and metal plate bending machine of claim 23 wherein first ramp member includes a substantially horizontal surface opposite its angled surface; said mounting assembly for mounting said first ramp member to said frame comprises a horizontal member adjacent said horizontal surface of said first ramp member; said first ramp member being slidably mounted to said horizontal member.

25. The metal sheet and metal plate bending machine of claim 24 wherein said horizontal member has one of a groove and a tennon in a surface adjacent said first ramp member horizontal surface, and said ramp member has another of said groove and tennon in its horizontal surface; said tennon and groove being complimentary shaped, said tennon being slidably received in said groove.

26. The metal sheet and metal plate bending machine of claim 24 wherein said linear motion device includes a bolt, said pivoting mechanism including a leg extending generally parallel to said outer surface of the first ramp member, said bolt extending through said leg and being connected to said first ramp member, whereby rotation of said bolt in a first direction moves said first ramp member in said first direction and rotation of said bolt in a second, opposite, direction, moves said ramp member in said second direction.

27. The metal sheet and metal plate bending machine of claim 22 further including first and second pairs of guide plates, the first pair of guide plates extending adjacent the sides of the first wedge and on the outside of the first ramp; and the second pair of guide plates extending adjacent the sides of the second wedge and on the outside of the second ramp, said machine also including a rod passing through said first and second wedges to connect said first and second pairs of guide plates, respectively.

28. The metal sheet and metal plate bending machine of claim 22 wherein the frame comprises a base plate, said guide plate extending upwardly from said base plate.

29. The metal sheet and metal plate bending machine of claim 28 including ground engaging members upon which said base plate rests, said ground engaging members including a foot plate which engages the ground and a resilient pad on said foot plate, said base plate being on top of said resilient pad.

30. A machine for bending sheets and plates of metal comprising:

(a) a frame;

(b) a bed mounted to the frame;

(c) a ram movably mounted to move vertically up and down relative to the frame the ram having a generally horizontally extending edge so that the horizontal edge can be moved vertically toward the bed to bend a metal sheet or plate located between the bed and the horizontal edge of the ram;

(d) an assembly for moving the ram vertically toward and away from the bed to bend sheets and plates of metal placed between the bed and the horizontal edge of the ram, comprising:

(i) a first wedge and a second wedge mounted to slide horizontally relative to the frame and in horizontal sliding relationship to the horizontal edge of the ram, with the sliding relationship of each wedge relative to one of the ram or the frame being along an inclined surface;

(ii) first and second ramp members mounted to one of the ram or bed; said first and second ramp members being positionally fixed relative to the frame during movement of the ram; the first and second ramp members being positioned to correspond to the first wedge and second wedge, respectively; each of the first and second ramp members having a first substantially flat angled surface that faces its corresponding wedge, the first and second wedges each having a substantially flat angled surface that faces the first surface of its corresponding ramp member, so that the first and second wedges can slide in first and second directions along the first and second ramp members, respectively, so that when the wedges are moved horizontally in one of said first and second directions relative to the ramp members, the ram is moved vertically relative to the bed to bend sheets and plates of metal positioned between the bed and the horizontal edge of the ram; and (iii) an actuator located between the first and second wedges, with means for connecting the actuator to the first and second wedges to drive the wedges horizontally relative to the frame in first and second directions along the first and second ramps respectively; and (e) dampening means for substantially preventing the force from the horizontal movement of the first and second wedges from being transferred to the frame; said dampening means comprising first and second dampening assemblies spaced horizontally from one another, each dampening assembly comprising a ram plate mounted to the ram to move vertically with vertical movement of the ram; a first gib plate mounted to the ram plate, a second gib plate mounted to the first gib plate, and bearing material positioned between said second gib plate and the fixed wedge and mounted to one of said second gib plate and fixed wedge, such that horizontal force applied by the first wedge to the first ramp member is transferred to the first dampening assembly, and horizontal force applied by the second wedge to the second ramp member is transferred to the second dampening assembly.

* * * * *

UNITED STATES PATENT AND TRADEMARK OFFICE

CERTIFICATE OF CORRECTION

PATENT NO : 5,878,618

DATED : March 9, 1999

INVENTOR(S) : Leo Henry Stalzer

It is certified that error appears in the above-identified patent and that said Letters Patent is hereby corrected as shown below:

Col. 18, Line 22
The word "ran", should read ---ram---

Signed and Sealed this

Twentieth Day of March, 2001

Nicholas P. Godici

*Attest:*

NICHOLAS P. GODICI

*Attesting Officer*

*Acting Director of the United States Patent and Trademark Office*